US006261755B1

(12) United States Patent
Gibson et al.

(10) Patent No.: US 6,261,755 B1
(45) **Date of Patent: *Jul. 17, 2001**

(54) PHOTOGRAPHIC ELEMENTS CONTAINING BLEND OF CYAN DYE-FORMING COUPLERS

(75) Inventors: Danuta Gibson, Watford (GB); James S. Honan, Spencerport; Thomas A. Rosiek, Honeoye Falls, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/514,632

(22) Filed: Feb. 28, 2000

(30) Foreign Application Priority Data

Mar. 10, 1999 (GB) ..... 9905544

(51) Int. Cl.[7] ..... G03C 1/08; G03C 7/26; G03C 7/32

(52) U.S. Cl. ..... 430/549; 430/552; 430/553; 430/384; 430/385; 430/546; 430/551

(58) Field of Search ..... 430/543, 549, 430/552, 553, 384, 385, 546, 551

(56) References Cited

U.S. PATENT DOCUMENTS 4,537,857 8/1985 Takada et al. .
4,609,619 9/1986 Katoh et al. .

(List continued on next page.)

FOREIGN PATENT DOCUMENTS 0 159 914 10/1985 (EP) .
59/111645 6/1984 (JP) .

OTHER PUBLICATIONS

JO 2035–450–A—Konica—Abstract—Feb. 06, 1990.
JO 1253–742–A—Konica—Abstract—Oct. 11, 1989.
JP 0421252–A—Fuji—Abstract—Aug. 3, 1992.
JP 04163448–A—Konica—Abstract—Jun. 09, 1992.
J5 9111–645–A—Konishiroku—Abstract.

*Primary Examiner*—Geraldine Letscher
(74) *Attorney, Agent, or Firm*—Arthur E. Kluegel

(57) ABSTRACT

The invention provides a photographic element comprising at least one light-sensitive silver halide emulsion layer having associated therewith:

(A) a phenolic cyan dye-forming narrow bandwidth "NB coupler";

(B) a phenolic cyan dye-forming coupler of formula (II):

(II)

wherein:

$R_3$ is an unsubstituted or substituted alkyl or aryl group or a 5–10 membered heterocyclic ring which contains one or more heteroatoms selected from nitrogen, oxygen and sulfur, which ring is unsubstituted or substituted;

$R_4$ is an unsubstituted or substituted alkyl group;

$R_5$ is hydrogen, halogen or an unsubstituted or substituted alkyl or aryl group or a 5–10 membered heterocyclic ring which contains one or more heteroatoms selected from nitrogen, oxygen and sulfur, which ring is unsubstituted or substituted; and Z is a hydrogen atom or a group which can be split off by the reaction of the coupler with an oxidized color-developing agent; and (C) a stabilizer of formula (III)

(III)

wherein:

each Y is an independently selected substituent and m is 0 to 4; and each T is an independently selected substituent and p is 0 to 4.

Preferably the element has associated therewith one or more high-boiling solvents of formula (IV)

(IV)

wherein:

$R^1$ is an unsubstituted or substituted alkyl or aryl group; and

G is an unsubstituted or substituted alkyl group.

32 Claims, 1 Drawing Sheet

U.S. PATENT DOCUMENTS

| | | | | |
|---|---|---|---|---|
| 4,666,826 | | 5/1987 | Takada et al. . | |
| 4,775,616 | | 10/1988 | Kilminster et al. . | |
| 4,849,328 | | 7/1989 | Hoke et al. . | |
| 5,008,180 | | 4/1991 | Merkel et al. . | |
| 5,045,442 | | 9/1991 | Hoke . | |
| 5,183,729 | | 2/1993 | Naito et al. . | |
| 5,378,596 | | 1/1995 | Naruse et al. . | |
| 5,484,696 | | 1/1996 | Jain et al. . | |
| 5,561,037 | | 10/1996 | Jain et al. . | |
| 5,565,312 | | 10/1996 | Jain . | |
| 5,681,690 | | 10/1997 | Tang et al. . | |
| 5,686,235 | | 11/1997 | Lau et al. . | |
| 5,962,198 | * | 10/1999 | Lau et al. | 430/385 |
| 5,972,574 | | 10/1999 | Fischer et al. . | |
| 5,976,777 | | 11/1999 | Harder et al. . | |
| 6,110,658 | * | 10/1999 | Honan et al. | 430/546 |

* cited by examiner

PHOTOGRAPHIC ELEMENTS CONTAINING BLEND OF CYAN DYE-FORMING COUPLERS

FIELD OF THE INVENTION

The present invention relates to a color photographic element containing phenolic cyan couplers and in particular to a combination of two classes of phenolic cyan couplers with a specific class of UV absorber.

BACKGROUND OF THE INVENTION

In silver halide based color photography, a typical photographic element contains multiple layers of light-sensitive photographic silver halide emulsions coated on a support with one or more of these layers being spectrally sensitized to each of blue light, green light and red light. The blue, green and red light-sensitive layers typically contain yellow, magenta, and cyan dye-forming couplers, respectively. After exposure to light, color development is accomplished by immersing the exposed material in an aqueous alkali solution containing an aromatic primary amine color-developing agent. The dye-forming couplers are selected so as to react with the oxidized color-developing agent to provide yellow, magenta and cyan dyes in the so called subtractive color process to reproduce their complementary colors, blue, green and red as in the original image.

The important features for selecting the dye-forming coupler include; efficient reaction with oxidized color-developing agent, thus minimizing the necessary amounts of coupler and silver halide in the photographic element; the formation of dyes with hues appropriate for the photographic use of interest: for color photographic paper applications this requires that dyes have low unwanted side absorption leading to good color reproduction in the photographic print; minimization of image dye loss contributing to improved image permanence under both ambient illumination and conventional storage conditions; and in addition the selected dye-forming coupler must exhibit good solubility in coupler solvents, provide good dispersibility in gelatin and remain stable during handling and manipulation for maximum efficiency in manufacturing processes.

In recent years, a great deal of study has been conducted to improve dye-forming couplers for silver halide photosensitive materials in terms of improved color reproducibility and image dye stability. However, further improvements are needed, particularly in the area of cyan couplers. In general, cyan dyes are formed from naphthols and phenols as described, for example, in U.S. Pat. Nos. 2,367,351, 2,423,730, 2,474,293, 2,772,161, 2,772,162, 2,895,826, 2,920,961, 3,002,836, 3,466,622, 3,476,563, 3,552,962, 3,758,308, 3,779,763, 3,839,044, 3,880,661, 3,998,642, 4,333,999, 4,990,436, 4,960,685, 5,476,757 and 5,614,357; in French Patent Nos. 1,478,188 and 1,479,043 and in UK Patent No. 2,070,000.

These types of couplers can be used either by being incorporated in the photographic silver halide emulsion layers or externally in the processing baths. In the former case the couplers must have ballast substituents built into the molecule to prevent the couplers from migrating from one layer into another. Although these couplers have been used extensively in color photographic film and paper products, the dyes derived from them still suffer from poor stability to heat, humidity or light, low coupling efficiency or optical density, and in particular from undesirable blue and green absorptions which cause considerable reduction in color reproduction and color saturation.

Cyan couplers which have been recently proposed to overcome some of these problems are 2,5-diacylaminophenols containing a sulfone, sulfonamido or sulfate moiety in the ballasts at the 5-position, as disclosed in U.S. Pat. Nos. 4,609,619, 4,775,616, 4,849,328, 5,008,180, 5,045,442, and 5,183,729, and Japanese patent applications JP02035450 A2, JP01253742 A2, JP04163448 A2, JP04212152 A2 and JP05204110 A2. Even though cyan image dyes formed from these couplers show improved stability to heat and humidity, enhanced optical density and resistance to reduction by ferrous ions in the bleach bath, the dye absorption maxima ($\lambda_{max}$) are too bathochromically shifted (i.e. shifted to the red end of the visible spectrum) and the absorption spectra are too broad, with considerable amounts of undesirable blue and green absorptions. Thus, these couplers are not practical for use in color papers.

The hue of a dye is a function of both the shape and the position of its spectral absorption band. Traditionally, the cyan dyes used in color photographic papers have had nearly symmetrical absorption bands centered in the region of 620 to 680 nm, preferably 630 to 660 nm, and more preferably 635 to 655 nm. Such dyes have rather a large amount of unwanted absorption in the green and blue regions of the spectrum.

More desirable would be a dye whose absorption band is asymmetrical in nature and biased towards the green region, i.e. with a steep slope on the short wavelength side. Such a dye would suitably peak at a shorter wavelength than a dye with a symmetrical absorption band, but the exact position of the desired peak depends on several factors including the degree of asymmetry and the shapes and positions of the absorption bands of the magenta and yellow dyes with which it is associated.

Recently, Lau et al. in U.S. Pat. No. 5,686,235 describe a particular class of cyan dye-forming coupler that has been shown to improve dye thermal stability and hue, particularly, with decreased absorption in side bands and an absorption band that is asymmetrical in nature. However it has been found in particular that dye light stability of materials containing such couplers is unsatisfactory. Some improvements to dye light and thermal stability of such cyan couplers have been obtained by the use of certain phenolic solvents and bisphenol stabilizers. However further improvement in dye light stability is still required to provide a satisfactory performance.

The 2,5-diacylaminophenol couplers in U.S. Pat. Nos. 5,047,314, 5,047,315, 5,057,408, 5,162,197 and 5,726,003 are of the type which yield dyes with symmetrical absorption bands and high side-band absorptions. The use of certain ester coupler solvents is described in both U.S. Pat. Nos. 5,047,315 and 5,057,408, where examples show these solvents with 2,5-diacylaminophenols. The couplers in these patents are typically embodied in formats with benzotriazole UV absorbers which can provide improved dye stability to light. However these patents do not provide teaching suitable for understanding how these couplers or stabilizers, and especially the couplers of U.S. Pat. No. 5,686,235, affect dye formation efficiency or how they affect unwanted side-band absorption.

Combinations of two classes of phenolic cyan dye-forming couplers are disclosed in U.S. Pat. Nos. 4,537,857, 4,552,836, 4,614,710, 4,666,826, 5,084,375, 4,820,614 and in JP 02 178,259 and JP 02 237,449.

U.S Pat. No. 5,047,314 discloses a 2,5-diacylaminophenol or 2-acylureido-5-acylaminophenol cyan coupler in combination with a 2-acylamino-5-substituted phenol cyan coupler, a benzotriazole stabilizer and a soluble polymer. However these combinations provide more unwanted green absorptions than is acceptable since the left bandwidth is too broad. Moreover there is no disclosure of a cyan coupler with a narrow left bandwidth which can provide the desired color rendition properties, as hereinafter described.

PROBLEM TO BE SOLVED BY THE INVENTION

There is still a need to provide a photographic element containing a dispersion of cyan dye-forming couplers which can provide improved light and dark stability under normal storage conditions, improved color reproduction in the generation of photographic images and high reactivity for formation of dye with oxidized color-developing agent.

SUMMARY OF THE INVENTION

The invention provides a photographic element comprising at least one light-sensitive silver halide emulsion layer having associated therewith:

(A) a phenolic cyan dye-forming "NB coupler", as herein defined;

(B) a phenolic cyan dye-forming coupler of formula (II):

(II)

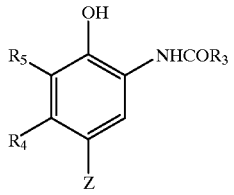

wherein:

$R_3$ is an unsubstituted or substituted alkyl or aryl group or a 5–10 membered heterocyclic ring which contains one or more heteroatoms selected from nitrogen, oxygen and sulfur, which ring is unsubstituted or substituted;

$R_4$ is an unsubstituted or substituted alkyl group;

$R_5$ is hydrogen, halogen or an unsubstituted or substituted alkyl or aryl group or a 5–10 membered heterocyclic ring which contains one or more heteroatoms selected from nitrogen, oxygen and sulfur, which ring is unsubstituted or substituted, Z is a hydrogen atom or a group which can be split off by the reaction of the coupler with an oxidized color-developing agent; and (C) a stabilizer of formula (III)

(III)

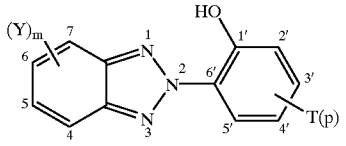

wherein:

each Y is an independently selected substituent and m is 0 to 4; and each T is an independently selected substituent and p is 0 to 4.

In another embodiment of the invention there is provided a multi-color photographic element comprising a support bearing yellow, magenta and cyan image-dye-forming units comprising at least one blue-, green- or red-sensitive silver halide emulsion layer having associated therewith at least one yellow, magenta or cyan dye-forming coupler respectively, wherein the element is as herein described.

In yet another embodiment of the invention there is provided a process of forming an image in a photographic element as hereinbefore defined after the element has been imagewise exposed to light, comprising contacting the element, as herein described, with a color-developing agent.

ADVANTAGEOUS EFFECT OF THE INVENTION

This invention allows for improved light and dark stability in a photographic element without degradation in hue or reactivity of the dyes therein by the use of a combination of two classes of cyan couplers and a specific UV absorber.

DETAILED DESCRIPTION OF THE INVENTION

Figure 1:
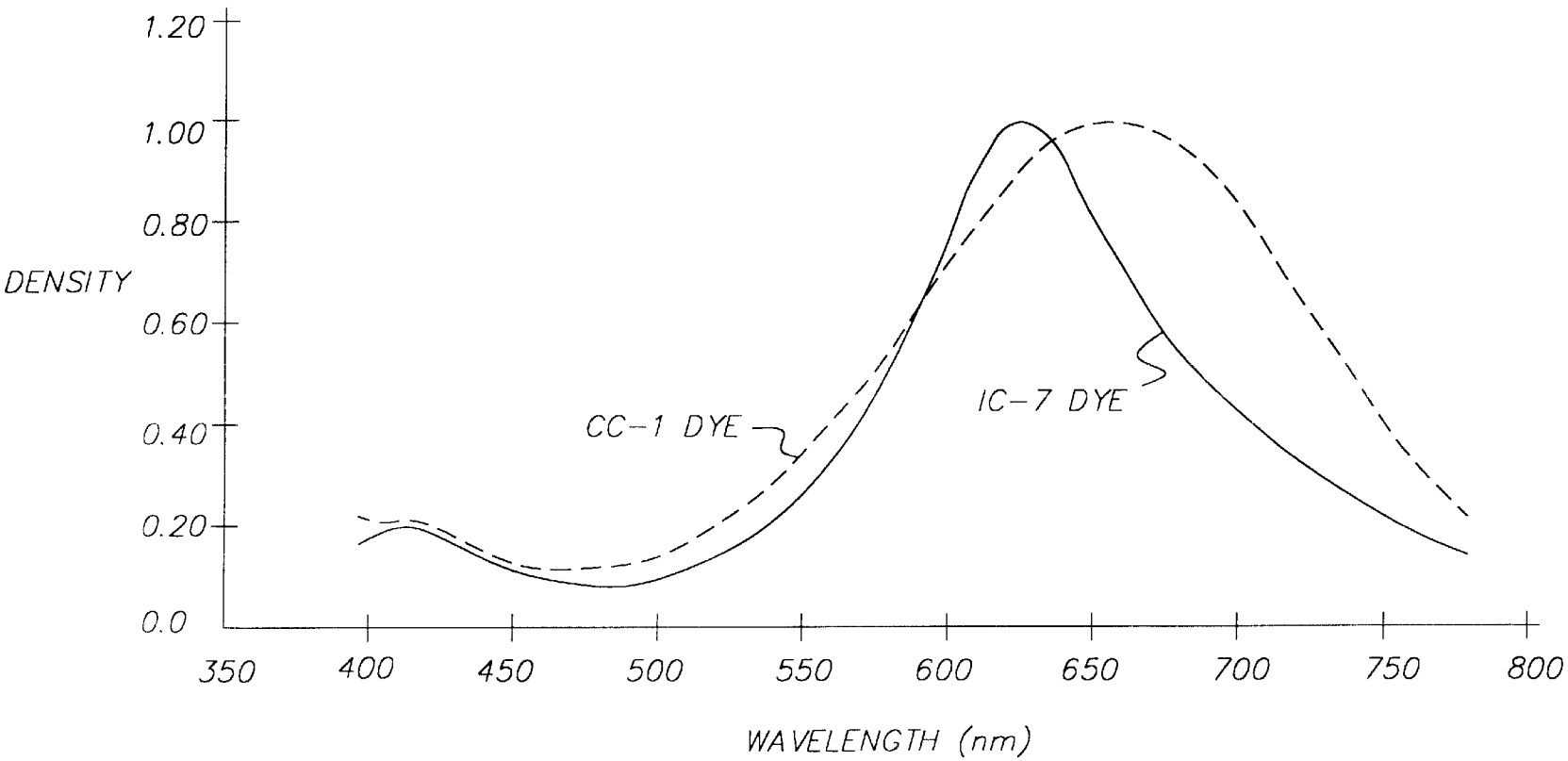
FIG. 1 shows the visible spectra generated from processed coatings for a conventional cyan dye-forming coupler, shown by the dotted line, and a cyan dye-forming "NB coupler", shown by the solid line, both couplers being dispersed in p-dodecylphenol (solvent J).

The invention relates to a photographic element containing a combination of two classes of cyan dye-forming couplers which upon processing in the conventional manner forms in the exposed areas, a cyan dye whose absorption spectrum is hypsochromically shifted (i.e. shifted toward the blue end of the spectrum) and sharp-cutting on its short wavelength side. The former is particularly necessary for prints obtained in accordance with conventional printing processes and the latter improves color reproduction and provides high color saturation. In accordance with the invention, these cyan couplers are combined with certain stabilizers and advantageously combined with certain solvents, which enables minimization of the amounts of coupler and silver necessary to achieve good photographic images, low unwanted side-band absorption particularly on the hypsochromic side of the absorption band, improved light stability which can be adjusted to achieve neutral fade with respect to the magenta and yellow dyes and good thermal stability for album keeping.

For the purposes of this invention, an "NB coupler" is any dye-forming coupler which is capable of coupling with the developer 4-amino-3-methyl-N-ethyl-N-(2-methanesulfonamidoethyl) aniline sesquisulfate hydrate to form a dye, which in di-n-butyl sebacate provides an absorption spectrum upon "spin coating" that has a left bandwidth (LBW) at least 5 nm less than the LBW for a 3% w/v solution of the same dye in acetonitrile. The LBW of the spectral curve for a dye is the distance between the left side of the spectral curve and the wavelength of maximum absorption measured at a density of half the maximum.

The "spin coating" sample is prepared as follows:

A solution of the dye (3% w/v) and di-n-butyl sebacate (3% w/v) in ethyl acetate is prepared. If the dye is insoluble, dissolution is achieved by the addition of some methylene chloride. The solution is filtered and 0. 1–0.2 ml is applied to a clear Estar support (approximately 4 cm×4 cm) and spun at 4,000 rev/min using the Spin Coating equipment, Model No. EC101, available from Headway Research Inc., Garland Tex. The transmission spectra of the so-prepared dye samples are then recorded.

Preferred "NB couplers" form a dye in di-n-butyl sebacate which has a LBW of the absorption spectrum upon "spin coating" which is at least 15 nm, preferably at least 25 nm, less than the LBW for a 3% w/v solution of the same dye in acetonitrile.

In a preferred embodiment the cyan dye-forming "NB coupler" useful in the invention has the formula (IA)

(IA)

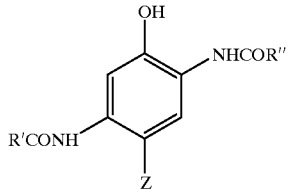

wherein:

R' and R" are substituents independently selected such that the coupler is a "NB coupler", as herein defined; and Z is a hydrogen atom or a group which can be split off by the reaction of the coupler with an oxidized color-developing agent.

In a further preferred embodiment the "NB coupler" has the formula (I):

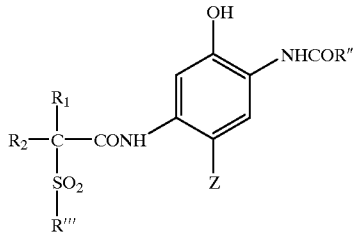

wherein:

R" and Z are as hereinbefore defined;

$R_1$ and $R_2$ are independently hydrogen or an unsubstituted or substituted alkyl group; and R'" is an unsubstituted or substituted alkyl, amino, alkoxy or aryl group or a 5–10 membered heterocyclic ring which contains one or more heteroatoms selected from nitrogen, oxygen and sulfur, which ring is unsubstituted or substituted.

In yet another preferred embodiment the element has associated therewith one or more high-boiling solvents of formula (IV)

(IV)

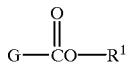

wherein:

$R^1$ is an unsubstituted or substituted alkyl (including aralkyl) or aryl group; and G is an unsubstituted or substituted alkyl (including aralkyl) group.

Cyan dye-forming "NB couplers", and in particular those couplers of formulae (I) or (IA), form image dyes having very sharp-cutting dye hues on the short wavelength side of the absorption curves with absorption maxima ($\lambda_{max}$) which are shifted hypsochromically and are generally in the range of 620–645 nm, which is ideally suited for producing excellent color reproduction and high color saturation in color photographic papers.

As used herein and throughout the specification unless where specifically stated otherwise, the term "alkyl" refers to an unsaturated or saturated, straight or branched chain alkyl group, including alkenyl and aralkyl, and includes cyclic alkyl groups, including cycloalkenyl, having 3–8 carbon atoms and the term "aryl" includes specifically fused aryl.

Referring to formula (IA) the substituents R' and R" are preferably independently selected from an unsubstituted or substituted alkyl, aryl, amino or alkoxy group or a 5–10 membered heterocyclic ring which contains one or more heteroatoms selected from nitrogen, oxygen and sulfur, which ring is unsubstituted or substituted.

When R' and/or R" are an amino or alkoxy group they may, for example, be substituted with a halogen, aryl-oxy or alkyl- or aryl-sulfonyl group. Suitably, however, R' and R" are independently selected from an unsubstituted or substituted alkyl or aryl group or a 5–10 membered heterocyclic ring, such as a pyridyl, morpholino, imidazolyl or pyridazolyl group.

R' is more preferably an alkyl group substituted, for example, with a halogen, alkyl, aryloxy or alkyl- or aryl-sulfonyl group, which may be further substituted. When R" is an alkyl group it may be similarly substituted.

However R" is preferably an unsubstituted aryl or heterocyclic ring, substituted, for example with a cyano, chloro, fluoro, bromo, iodo, alkyl- or aryl-carbonyl, alkyl- or aryl-oxycarbonyl, acyloxy, carbonamido, alkyl- or aryl-carbonamido, alkyl- or aryl-oxycarbonylamino, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfamoylamino, alkyl- or aryl-sulfonamido, aryl, alkyl, alkoxy, aryloxy, nitro, alkyl- or aryl-ureido or alkyl- or aryl-carbamoyl group, any of which may be further substituted. Preferred groups are halogen, cyano, alkoxycarbonyl, alkylsulfamoyl, alkyl-sulfonamido, alkylsulfonyl, carbamoyl, alkylcarbamoyl or alkylcarbonamido. When R' is an aryl or heterocyclic ring it may be similarly substituted.

Suitably, R" is a 4-chlorophenyl, 3,4-dichlorophenyl, 3,4-difluorophenyl, 4-cyanophenyl, 3-chloro-4-cyano-phenyl, pentafluorophenyl, or a 3- or 4-sulfonamido-phenyl group.

Referring to formula (I), $R_1$ and $R_2$ are independently hydrogen or an unsubstituted or substituted alkyl group, preferably having from 1 to 24 carbon atoms and in particular 1 to 10 carbon atoms, suitably a methyl, ethyl, n-propyl, isopropyl, butyl or decyl group or an alkyl group substituted, for example, with one or more fluoro, chloro or bromo atoms, such as a trifluoromethyl group. Suitably at least one of $R_1$ and $R_2$ is a hydrogen atom and if only one of $R_1$ and $R_2$ is a hydrogen atom then the other is preferably an alkyl group having 1 to 4 carbon atoms, more preferably one to three carbon atoms, desirably two carbon atoms and is preferably unsubstituted.

In formula (I), when R'" is an alkyl group it is preferably unsubstituted but may be substituted with, for example, a halogen or alkoxy group.

However R'" is preferably an aryl or heterocyclic group, (such as a pyridyl, morpholino, imidazolyl or pyridazolyl group) which may be substituted, preferably in a position not adjacent to the link with the sulfonyl group, (i.e. in the case of a phenyl ring these would be the meta and/or para positions), suitably with one to three substituents. Such substituents may be independently selected from those specified hereinbefore as substituents on R", when R" is an aryl or heterocyclic ring.

In particular each substituent may be an alkyl group such as methyl, t-butyl, heptyl, dodecyl, pentadecyl, octadecyl or 1,1,2,2-tetramethylpropyl; an alkoxy group such as methoxy, t-butoxy, octyloxy, dodecyloxy, tetra-decyloxy, hexadecyloxy or octadecyloxy; an aryloxy group such as phenoxy, 4-t-butylphenoxy or 4-dodecyl-phenoxy; an alkyl- or aryl-acyloxy group such as acetoxy or dodecanoyloxy; an alkyl- or aryl-acylamino group such as acetamido, hexadecanamido or benzamido; an alkyl- or aryl-sulfonyloxy group such as methyl-sulfonyloxy, dodecylsulfonyloxy or 4-methylphenyl-sulfonyloxy; an alkyl- or aryl-sulfamoyl group such as N-butylsulfamoyl or N-4-t-butylphenylsulfamoyl; an alky- or aryl-sulfamoylamino group such as N-butyl-sulfamoylamino or N-4-t-butylphenylsulfamoylamino; an alkyl- or aryl-sulfonamido group such as methane-sulfonamido, hexadecanesulfonamido or 4-chlorophenyl-sulfonamido; an alkyl- or aryl-ureido group such as methylureido or phenylureido; an alkoxy- or aryloxy-carbonyl such as methoxycarbonyl or phenoxycarbonyl; an alkoxy- or aryloxy-carbonylamino group such as methoxy-carbonylamino or phenoxycarbonylamino; an alkyl- or aryl-carbamoyl group such as N-butylcarbamoyl or N-methyl-N-dodecylcarbamoyl; or a perfluoroalkyl group such as trifluoromethyl or heptafluoropropyl.

Suitably the above substituent groups have 1 to 30 carbon atoms, more preferably 8 to 20 aliphatic carbon atoms. A most preferred substituent is an alkyl group of 12 to 18 aliphatic carbon atoms such as dodecyl, pentadecyl or octadecyl or an alkoxy group with 8 to 18 aliphatic carbon atoms such as dodecyloxy and hexa-decyloxy or a halogen such as a meta or para chloro group, carboxy or sulfonamido.

In formula (I) or (IA) Z is a hydrogen atom or a group which can be split off by the reaction of the coupler with an oxidized color-developing agent, known in the photographic art as a "coupling-off group" and may preferably be hydrogen, chloro, fluoro, substituted aryloxy or mercaptotetrazole, more preferably hydrogen or chloro.

In one embodiment, the coupler of formula (I) of the invention is a 2,5-diacylaminophenol cyan coupler in which the 5-acylamino moiety is an amide of a carboxylic acid which is substituted in the alpha position by a particular sulfone (—$SO_2$—) group, such as, for example, described in U.S. Pat. No. 5,686,235. The sulfone moiety includes an arylsulfone and is substituted only at the meta and/or para position of the aryl ring. In addition, the 2-acylamino moiety is an amide (—NHCO—) of a carboxylic acid, not a ureido (—NHCONH—) group.

Referring to formula (II), $R_3$ is an unsubstituted or substituted alkyl or aryl group or a 5–10 membered heterocyclic ring which contains one or more heteroatoms selected from nitrogen, oxygen and sulfur, which ring is unsubstituted or substituted. Preferably $R_3$ is an unsubstituted or substituted alkyl group, preferably substituted with an aryloxy or an alkyl- or aryl-sulfonyl group, each of which may be further substituted, for example, with a substituent as hereinbefore defined for an aryl or heterocyclic ring of R". When $R_3$ is an aryl or heterocyclic ring it may be substituted, for example with a halogen, cyano or an alkyl group, which may be further substituted.

$R_4$ is an alkyl group which is unsubstituted or substituted, for example with one or more halogen atoms, and is preferably an unsubstituted small chain alkyl group, especially an alkyl group having from one to four carbon atoms.

$R_4$ is hydrogen, halogen or an unsubstituted or substituted alkyl or aryl group or a 5–10 membered heterocyclic ring which contains one or more heteroatoms selected from nitrogen, oxygen and sulfur, which ring is unsubstituted or substituted. Preferably $R_5$ is halogen, more preferably chlorine, unsubstituted alkyl or an alkyl group substituted, for example, with halogen. When $R_5$ is an aryl or heterocyclic ring it may be substituted, for example with a halogen, cyano or an alkyl group, which may be further substituted.

When either $R_3$ and/or $R_5$ is a heterocyclic group this may be, for example, a pyridyl, morpholino, imidazolyl or pyridazolyl group.

Z is as defined for the coupler of formula (I) and (IA) and is preferably chloro, fluoro, substituted aryloxy or thiopropionic acid.

The presence or absence of such groups determines the chemical equivalency of the coupler, i.e. whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation and color correction.

Representative classes of such coupling-off groups include, for example, halogen, alkoxy, aryloxy, heterocyclyloxy, sulfonyloxy, acyloxy, acyl, heterocyclyl, sulfonamido, heterocyclylthio, benzo-thiazolyl, phosophonyloxy, alkylthio, arylthio and arylazo. These coupling-off groups are described in the art, for example, in U.S. Pat. Nos. 2,455,169, 3,227,551, 3,432,521, 3,467,563, 3,617,291, 3,880,661, 4,052,212 and 4,134,766; and in UK Patent Nos. and published applications 1,466,728, 1,531,927, 1,533,039, 2,066,755A and 2,017,704A, the disclosures of which are incorporated herein by reference. Halogen, alkoxy and aryloxy groups are most suitable.

Examples of suitable coupling-off groups are: —Cl, —F, —Br, —SCN, —$OCH_3$, —$OC_6H_5$, —$OCH_2C(=O)NHCH_2CH_2OH$, —$OCH_2C(O)NHCH_2CH_2OCH_3$, —$OCH_2C(O)NHCH_2CH_2OC(=O)OCH_3$, —$P(=O)(OC_2H_5)_2$, —$SCH_2CH_2COOH$,

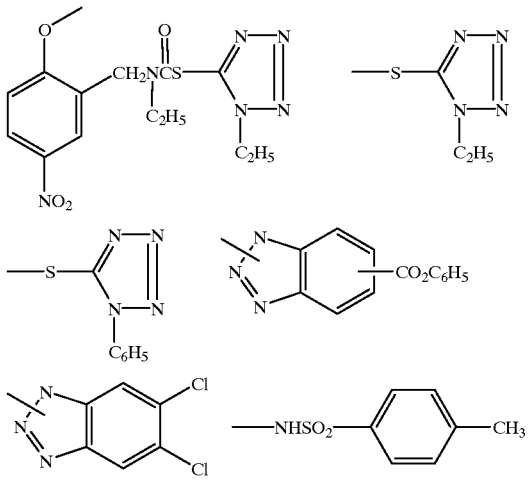

-continued

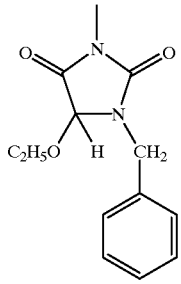

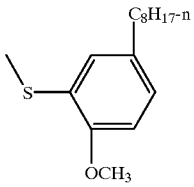

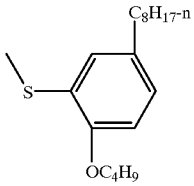

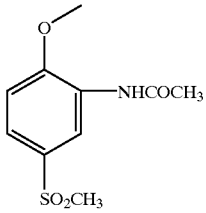

and

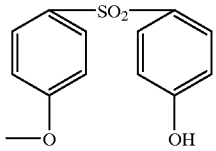

Typically the coupling-off group is a chlorine atom, hydrogen or a p-methoxyphenoxy group.

It is important that the substituent groups R', R", R'", $R_1$–$R_5$ and Z are selected so as to adequately ballast the coupler and the resulting dye in the organic solvent in which the coupler is dispersed. The ballasting may be accomplished by providing hydrophobic substituent groups in one or more of these substituent groups. Generally a ballast group is an organic radical of such size and configuration as to confer on the coupler molecule sufficient bulk and aqueous insolubility as to render the coupler substantially non-diffusible from the layer in which it is coated in a photographic element. Thus the combination of these substituent groups in the couplers for use in the invention are suitably chosen to meet these criteria. To be effective, the ballast will usually contain at least 8 carbon atoms and typically contains 10 to 30 carbon atoms. Suitable ballasting may also be accomplished by providing a plurality of groups which in combination meet these criteria. In the preferred embodiments of the invention, $R_1$ and/or $R_2$ in formula (I) is hydrogen or a small alkyl group and $R_4$ in formula (II) is a small alkyl group. Therefore, in these embodiments the ballast in formula (I) would be primarily located as part of groups R", R'", Z and in formula (II) in $R_3$, $R_5$ and Z. Furthermore, even if the coupling-off group Z contains a ballast it is often necessary to ballast the other substituents as well, since Z is eliminated from the molecule upon coupling; thus, the ballast is most advantageously provided as part of groups R", R'", $R_3$ and/or $R_5$ in couplers of formulae (I) and (II).

The following examples further illustrate the invention. It is not to be construed that the present invention is limited to these examples.

Compounds of Formula (I)

IC-1

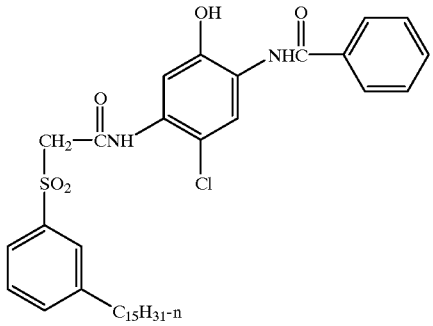

IC-2

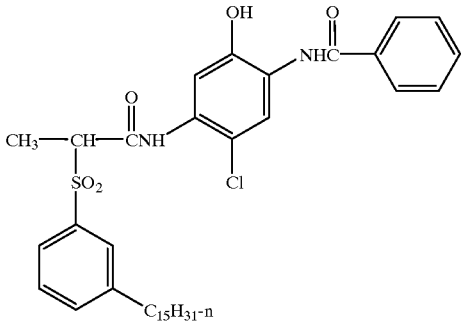

IC-3

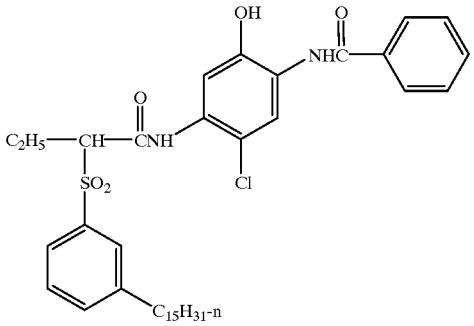

IC-4

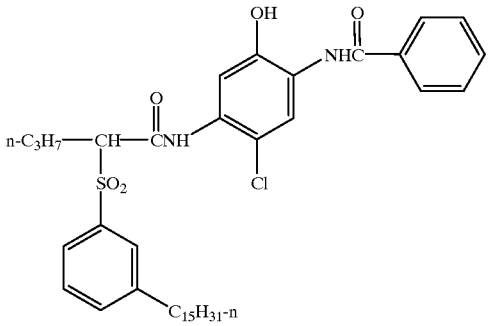

-continued
IC-5
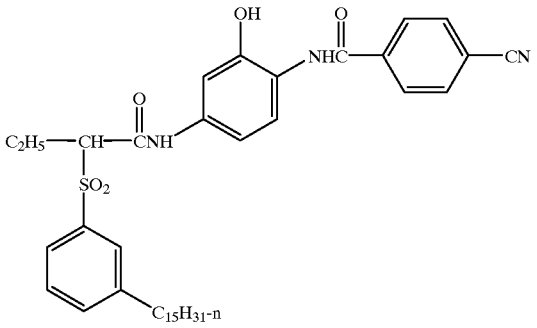
IC-6
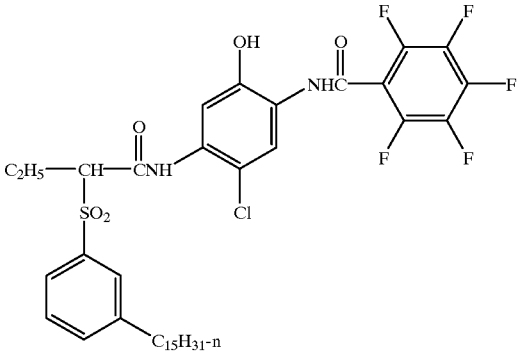
IC-7
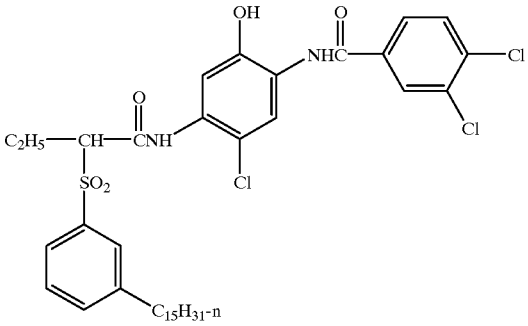
IC-8
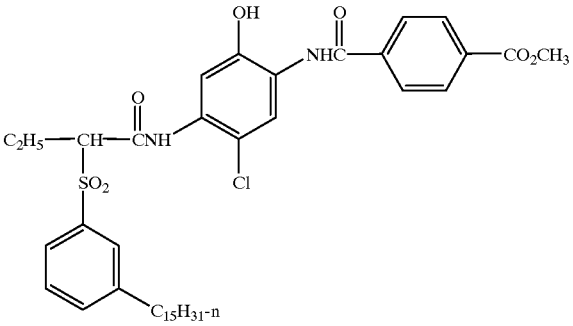
-continued
IC-9
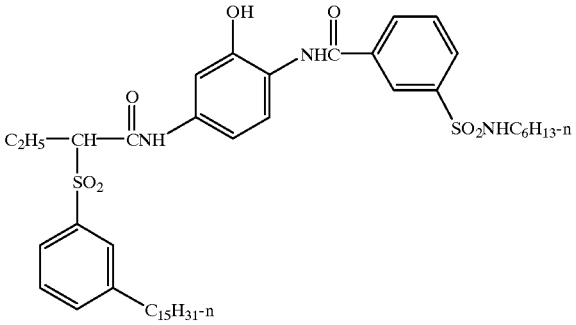
IC-10
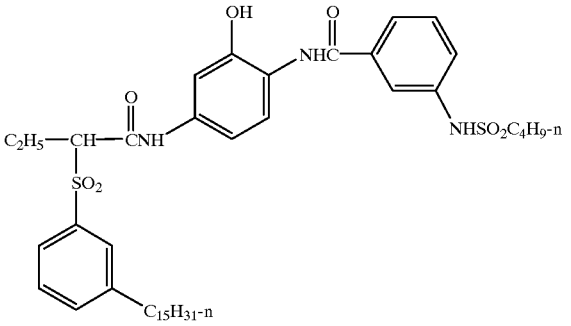
IC-11
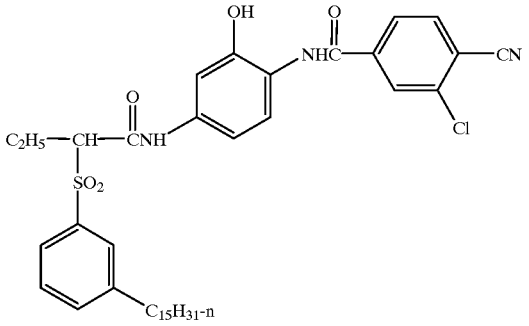
IC-12
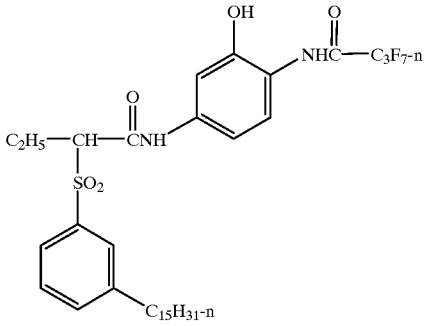

-continued
IC-13
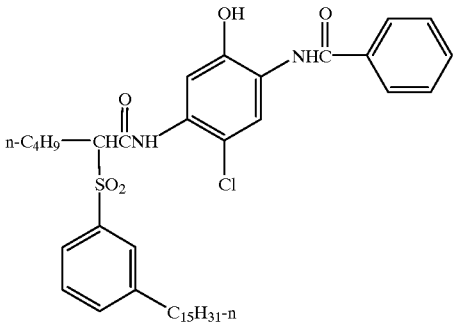
IC-14
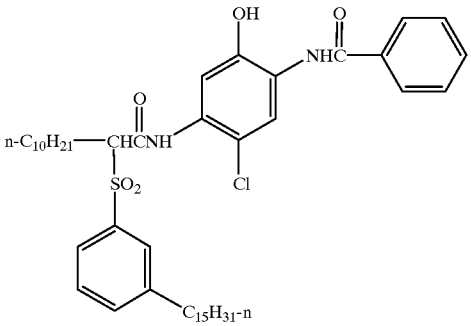
IC-15
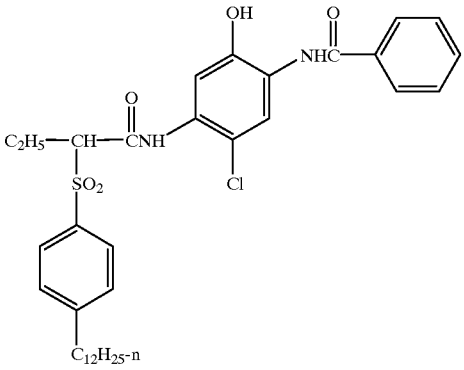
IC-16
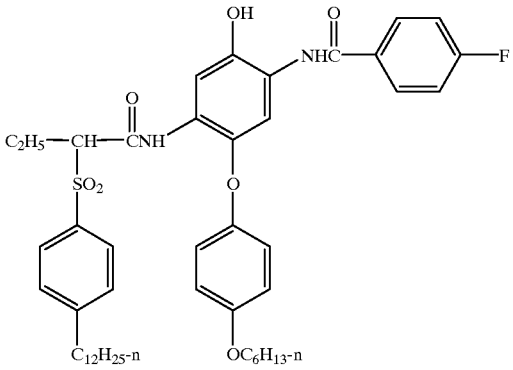
-continued
IC-17
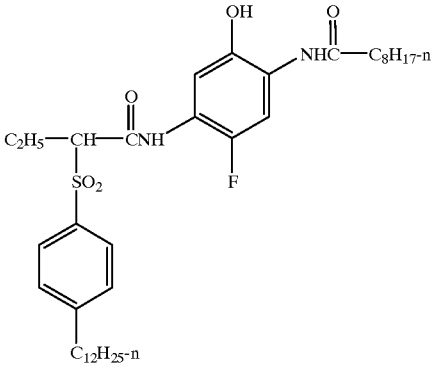
IC-18
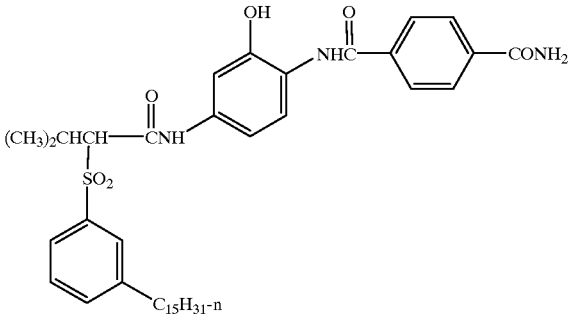
IC-19
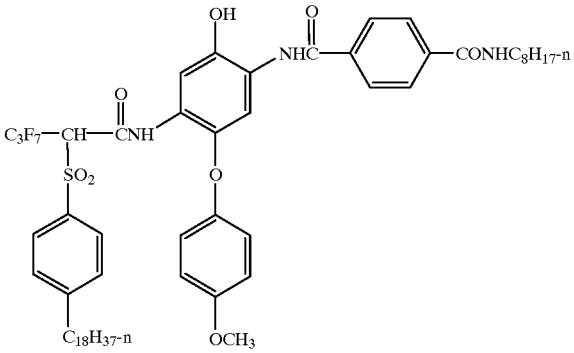
IC-20
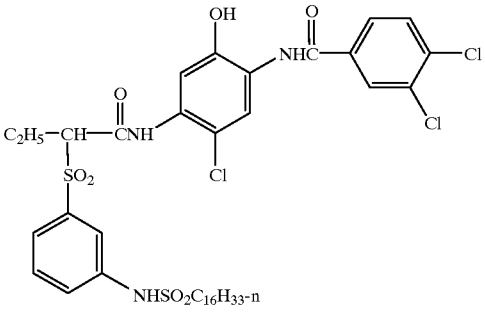

-continued
IC-21
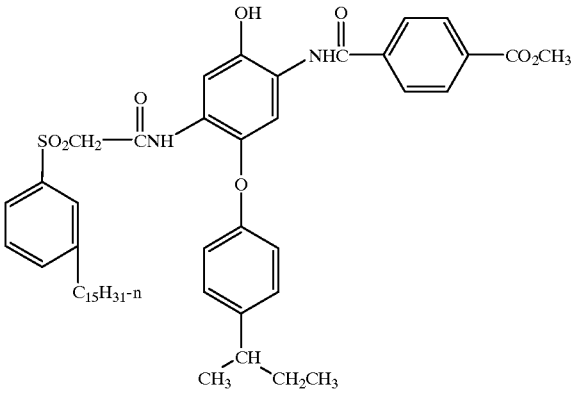
IC-22
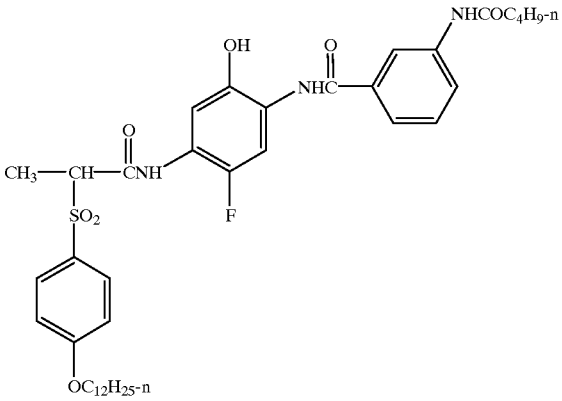
IC-23
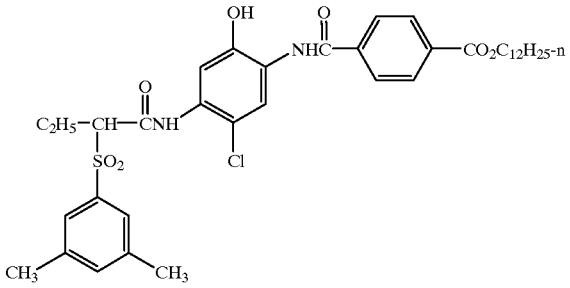
IC-24
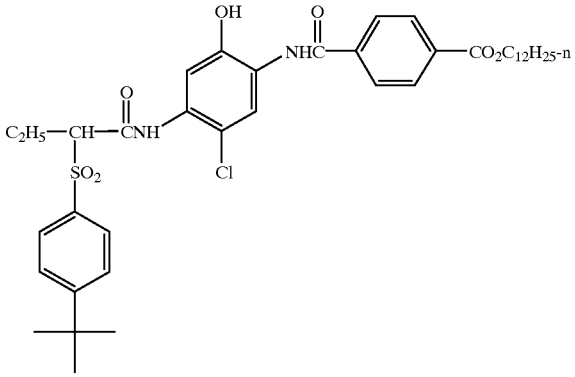
-continued
IC-25
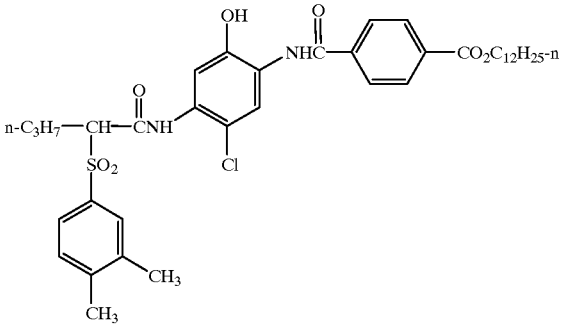
IC-26
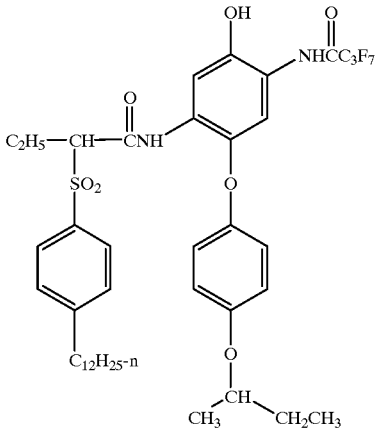
IC-27
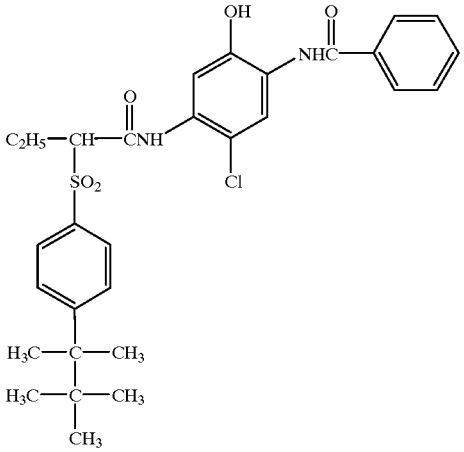
IC-28
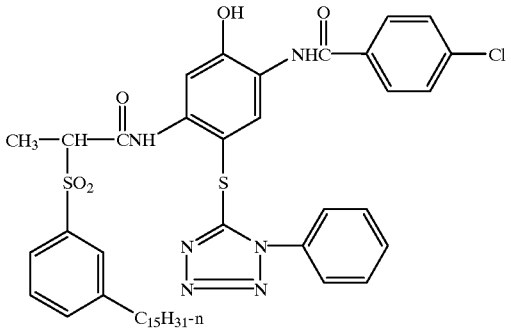

-continued
IC-29
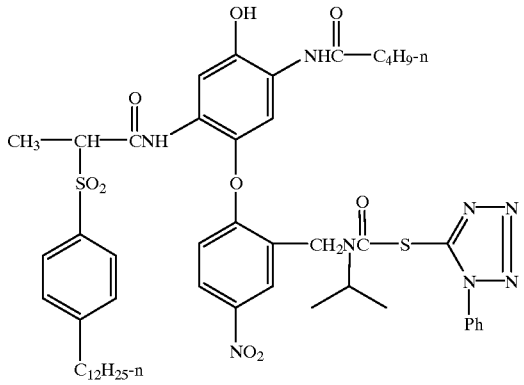
IC-30
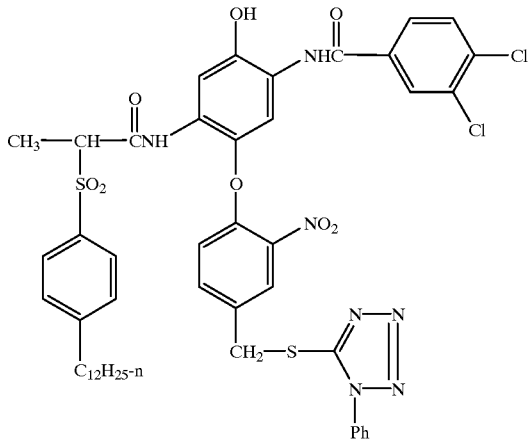
IC-31
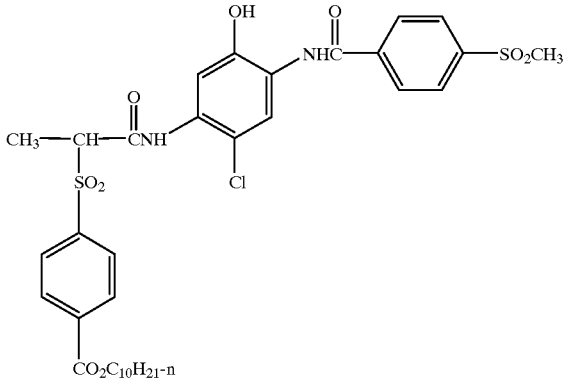
-continued
IC-32
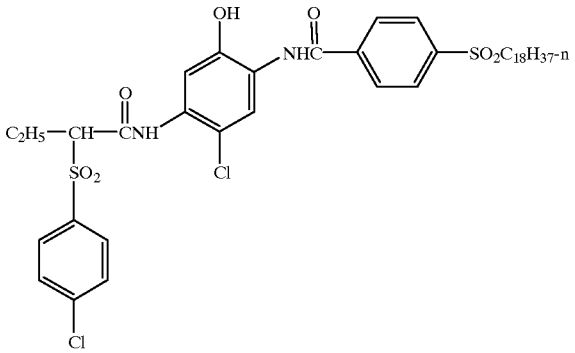
IC-33
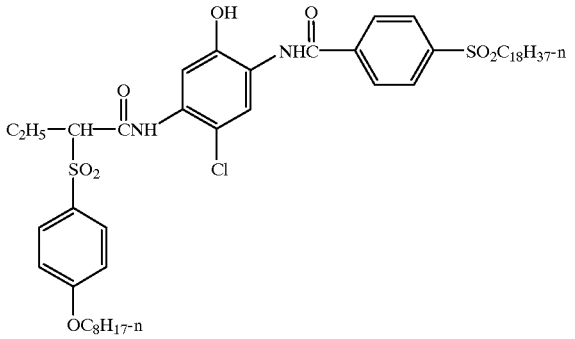
IC-34
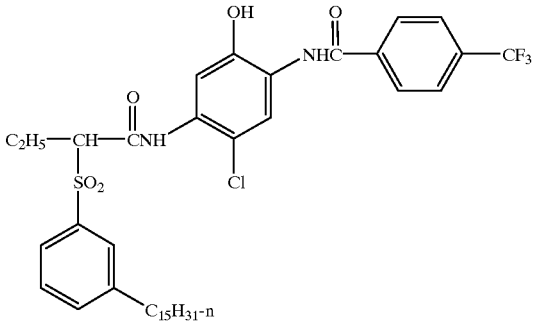
IC-35
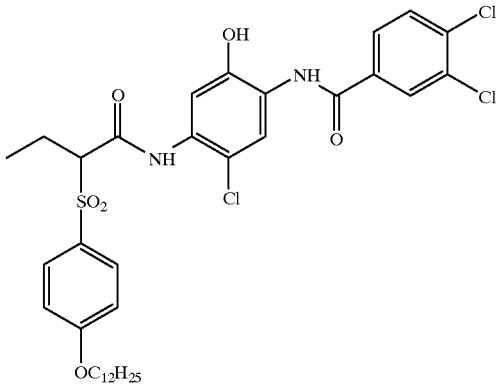

-continued
IC-36
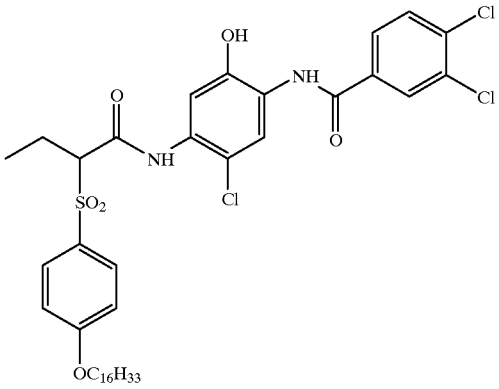
IC-37
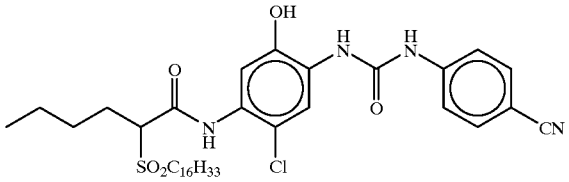
IC-38
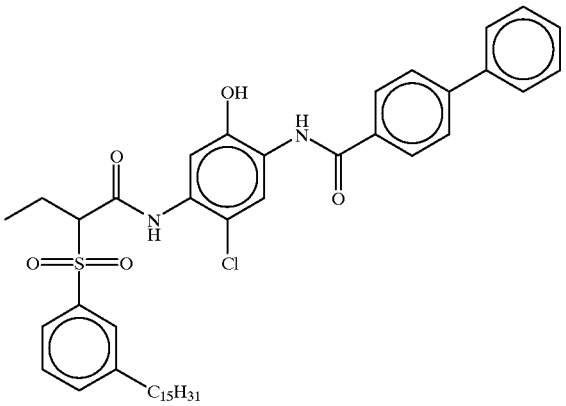
IC-39
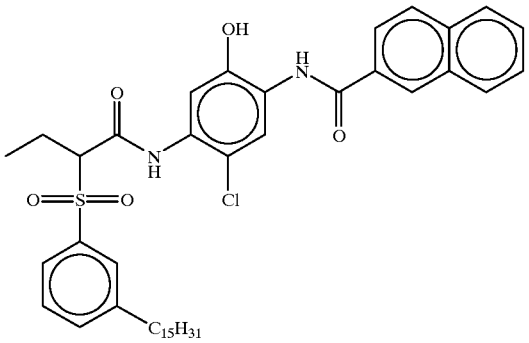
-continued
IC-40
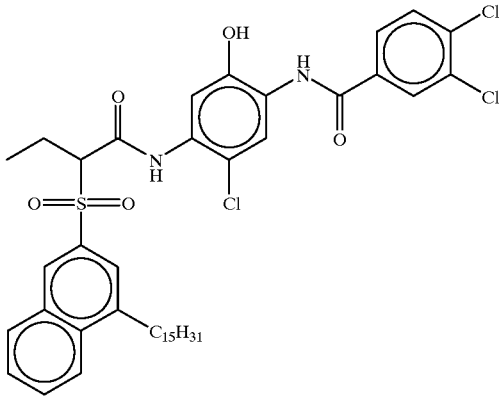
Preferred couplers are (IC-3),(IC-7), (IC-35) and (IC-36) because of their suitably narrow left bandwidths.
Compounds of Formula (II)
IIC-1
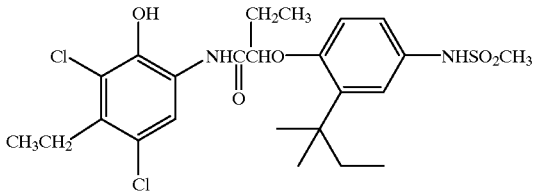
IIC-2
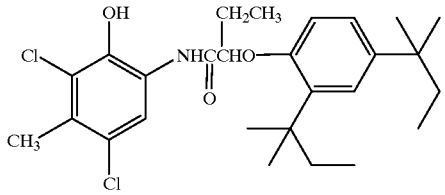
IIC-3
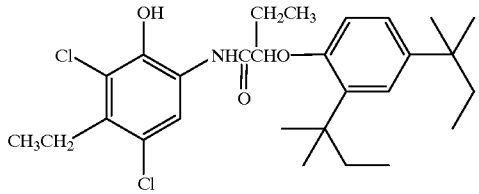
IIC-4
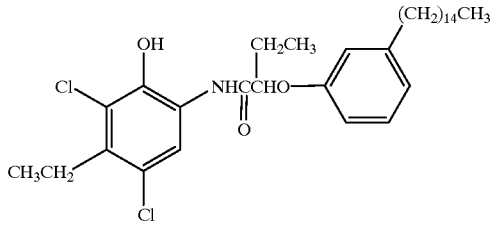

-continued
IIC-5
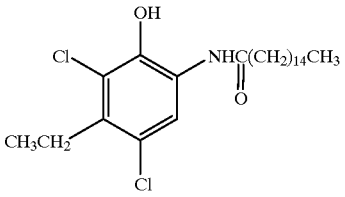
IIC-6
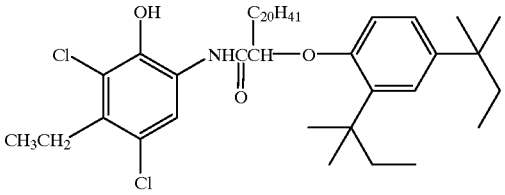
IIC-7
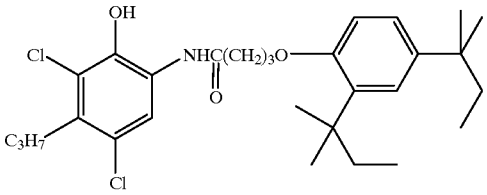
IIC-8
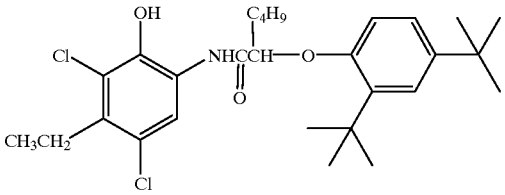
IIC-9
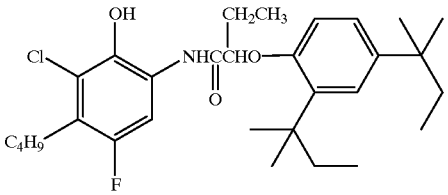
IIC-10
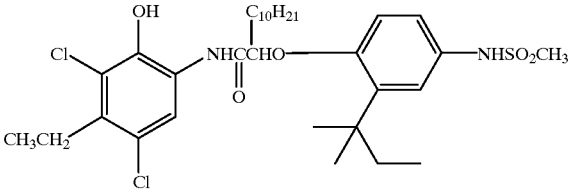
IIC-11
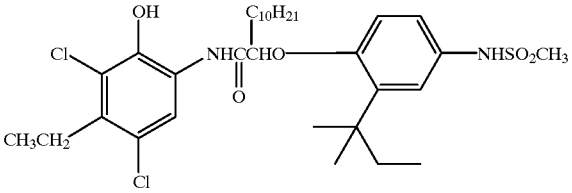
-continued
IIC-12
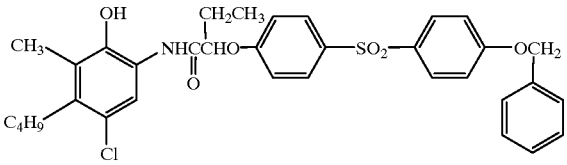
IIC-13
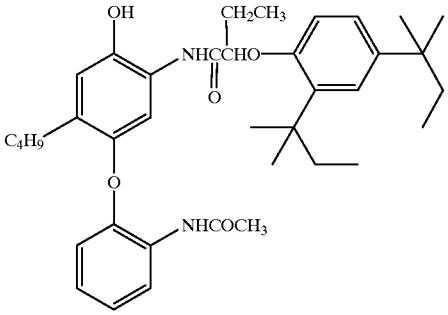
IIC-14
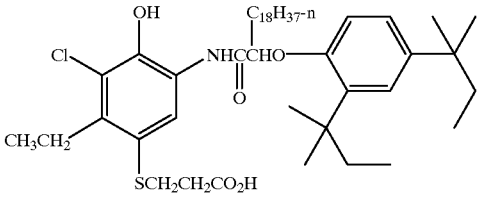
IIC-15
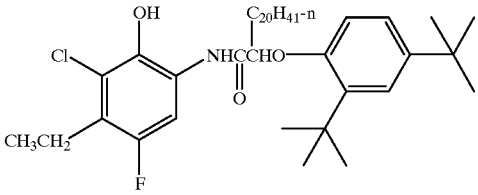
IIC-16
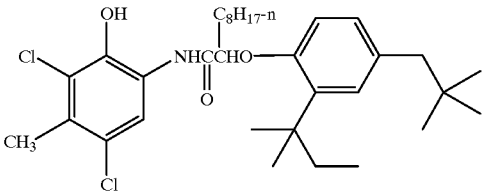
IIC-17
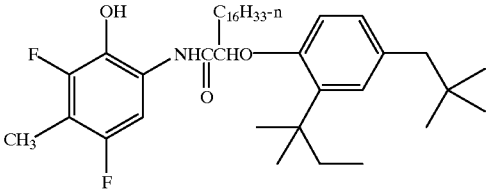

-continued

IIC-18

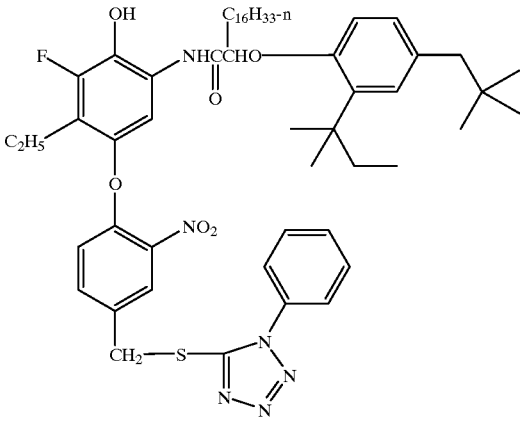

IIC-19

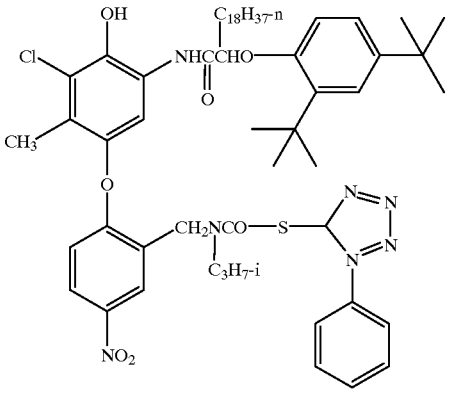

IIC-20

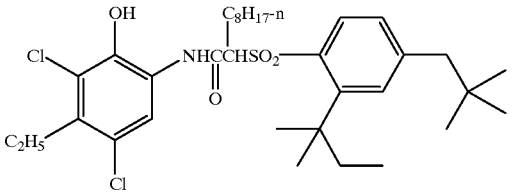

IIC-21

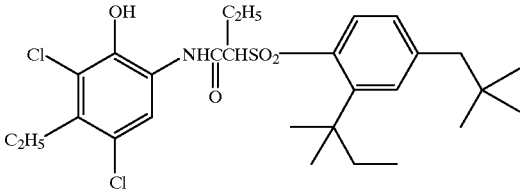

IIC-22

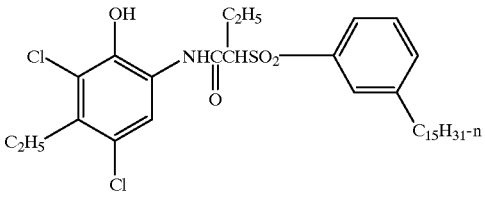

-continued

IIC-23

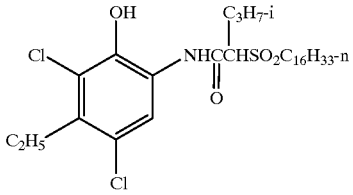

IIC-24

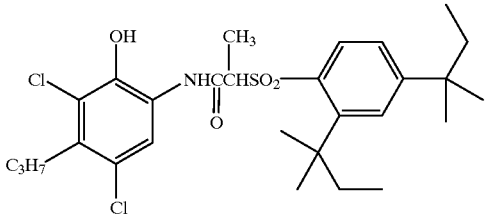

IIC-25

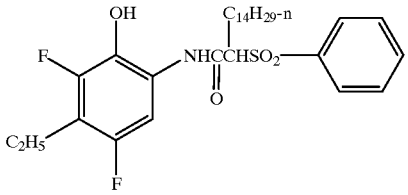

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy)propyl and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy and 2-dodecyloxyethoxy; aryl such as phenyl, 4-t-butyl-phenyl, 2,4,6-trimethylphenyl, naphthyl; aryloxy, such as phenoxy, 2-methylphenoxy, alpha- or beta-naphthyloxy and 4-tolyloxy; carbonamido, such as acetamido, benzamido, butyramido, tetradecanamido, alpha-(2,4-di-t-pentylphenoxy)acetamido, alpha-(2,4-di-t-pentyl-phenoxy) butyramido, alpha-(3-pentadecylphenoxy)-hexanamido, alpha-(4-hydroxy-3-t-butylphenoxy)-tetradecanamido, 2-oxopyrrolidin-1-yl, 2-oxo-5-tetra-decylpyrrolin-1-yl, N-methyltetradecanamido, N-succinimido, N-phthalimido, 2,5-dioxo-1-oxazolidinyl, 3-dodecyl-2,5-dioxo-1-imidazolyl and N-acetyl-N-dodecylamino, ethoxycarbonylamino, phenoxycarbonyl-amino, benzyloxycarbonylamino, hexadecyloxycarbonyl-amino, 2,4-di-t-butylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecyl-ureido, N-hexadecylureido, N,N-dioctadecylureido, N,N-dioctyl-N'-ethylureido, N-phenylureido, N,N-di-phenylureido, N-phenyl-N-p-toluylureido, N-(m-hexa-decylphenyl)ureido, N,N-(2,5-di-t-pentylphenyl)-N'-ethylureido and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoyl-amino and hexadecylsulfonamido; sulfamoyl, such as N-methylsulfamoyl, N-ethylsulfamoyl, N,N-dipropyl-sulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecyl-sulfamoyl and N-dodecylsulfamoyl; carbamoyl, such as N-methylcarbamoyl, N,N-dibutylcarbamoyl, N-octadecyl-carbamoyl, N-[4-(2,4-di-t-pentylphenoxy)butyl]-carbamoyl, N-methyl-N-tetradecylcarbamoyl and N,N-di-octylcarbamoyl; acyl, such as acetyl, (2,4-di-t-amyl-phenoxy)acetyl, phenoxycarbonyl, p-dodecyloxyphenoxy-carbonyl, methoxycarbonyl, butoxycarbonyl, tetradecyloxycarbonyl, ethoxycarbonyl, benzyloxycarbonyl, 3-pentadecyloxycarbonyl and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl and p-toluylsulfonyl; sulfonyl-oxy, such as dodecylsulfonyloxy and hexadecylsulfonyl-oxy; sulfinyl, such as methylsulfinyl, octylsulfinyl, 2-ethylhexylsulfinyl, dodecylsulfinyl, hexadecyl-sulfinyl, phenylsulfinyl, 4-nonylphenylsulfinyl and p-toluylsulfinyl; thio, such as ethylthio, octylthio, benzylthio, tetradecylthio, 2-(2,4-di-t-pentylphenoxy)-ethylthio, phenylthio, 2-butoxy-5-t-octylphenylthio and p-tolylthio; acyloxy, such as acetyloxy, benzoyloxy, octadecanoyloxy, p-dodecylamidobenzoyloxy, N-phenylcarbamoyloxy, N-ethylcarbamoyloxy and cyclohexyl-carbonyloxy; amino, such as phenylanilino, 2-chloro-anilino, diethylamino and dodecylamino; imino, such as 1 (N-phenylimido)ethyl, N-succinimido or 3-benzyl-hydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups. Generally, the above groups and substituents thereof may include those having up to 48 carbon atoms, typically 1 to 36 carbon atoms and usually less than 24 carbon atoms, but greater numbers are possible depending on the particular substituents selected.

Representative substituents on ballast groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arylsulfonyl, sulfonamido and sulfamoyl groups wherein the substituents typically contain 1 to 42 carbon atoms. Such substituents can also be further substituted.

The stabilizers for use in the present invention have the formula (III)

(III)

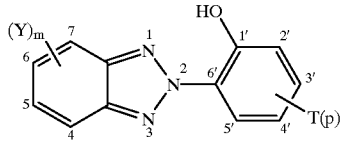

wherein:

each Y is an independently selected substituent and m is 0 to 4; and each T is an independently selected substituent and p is 0 to 4.

Suitably each Y is independently selected from hydrogen, halogen, nitro and a substituent selected from the group consisting of unsubstituted or substituted alkyl, aryl, alkoxy, aryloxy, acyloxy, alkyl- or aryl-thio, mono- or di-alkylamino, acylamino, alkoxycarbonyl and a 5-membered or 6-membered heterocyclic group containing a nitrogen, oxygen or sulfur atom, and m is 0 to 4.

Furthermore each T is suitably independently selected from hydrogen, halogen and a substituent selected from the group consisting of unsubstituted or substituted alkyl, aryl, alkoxy, aryloxy, acyloxy, alkyl or aryl-thio, mono- or di-alkylamino, acylamino and a 5-membered or 6-membered heterocyclic group containing a nitrogen, oxygen or sulfur atom, and p is 0 to 4.

More preferably the 5-position and/or 6-position of the benzotriazole ring is unsubstituted or substituted with chlorine, a nitro group, an unsubstituted alkyl or an alkoxy-carbonyl group. Furthermore the 3' and 5' positions of the phenyl ring are preferably unsubstituted and the 2'-and/or 4'-positions are preferably substituted with an unsubstituted or substituted alkyl, alkoxy or aryloxy group, especially a branched alkyl group, such as a t-butyl, t-pentyl or 2-ethylhexyl group, or an alkyl group substituted, for example, with an alkoxycarbonyl or substituted amino group. More preferably the ring is di-substituted at the 2'-and 4'-positions.

The following stabilizers further illustrate the invention. It is not to be construed that the present invention is limited to these examples.

ST-1

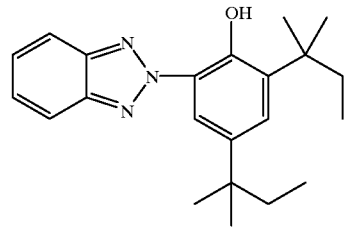

-continued
ST-2
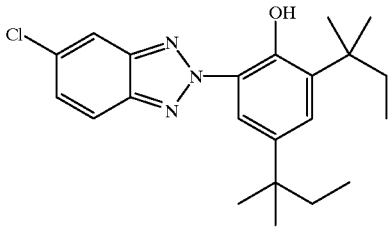
ST-3
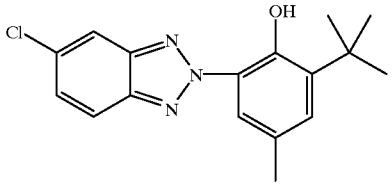
ST-4
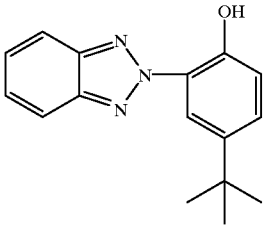
ST-5
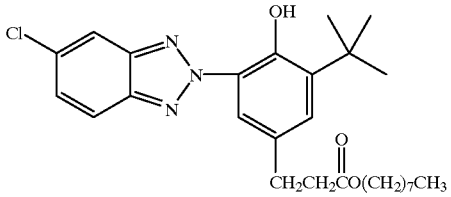
ST-6
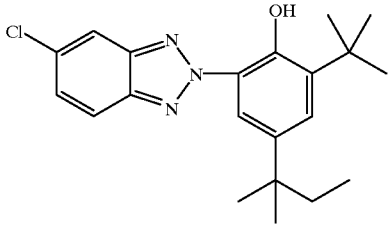
ST-7
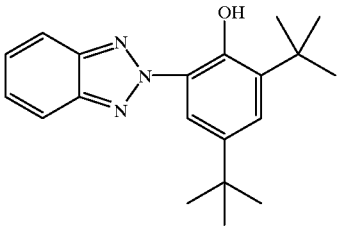
-continued
ST-8
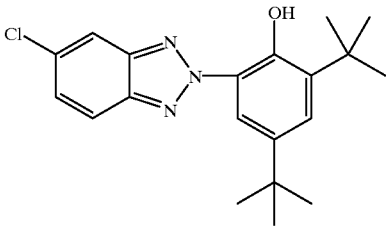
ST-9
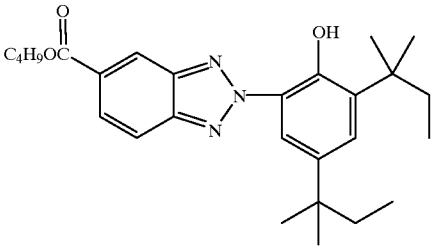
ST-10
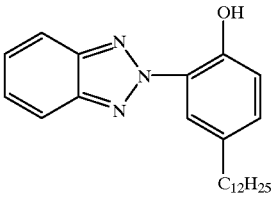
ST-11
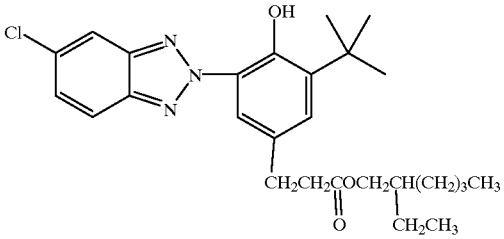
ST-12
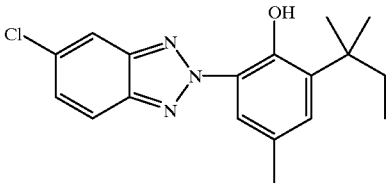
ST-13
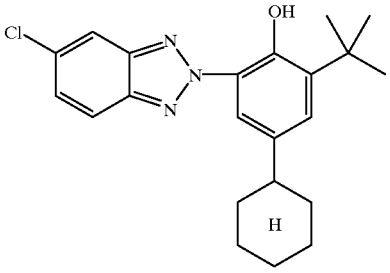

-continued

ST-14

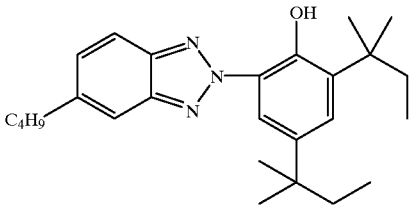

ST-15

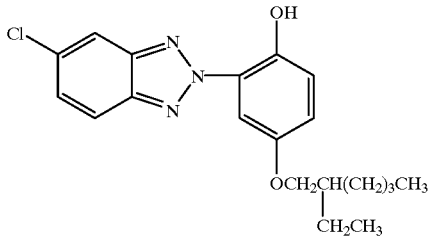

ST-16

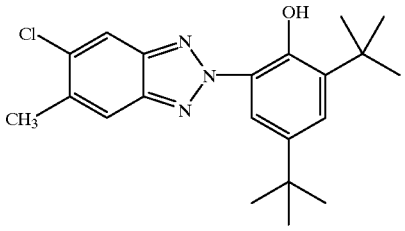

ST-17

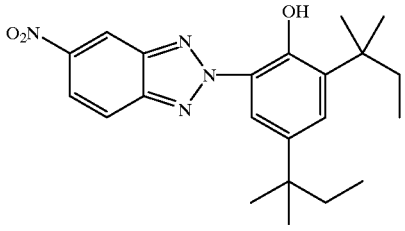

ST-18

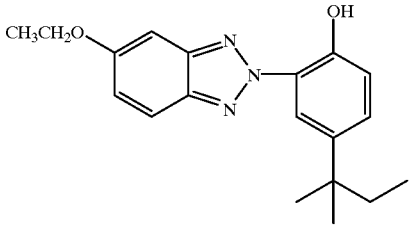

ST-19

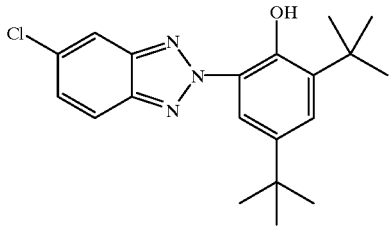

-continued

ST-20

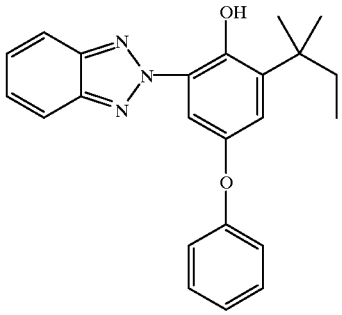

ST-21

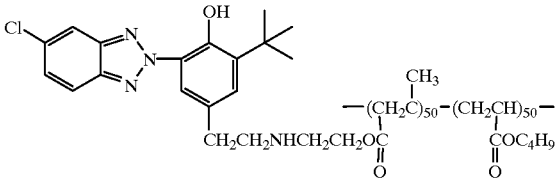

ST-22

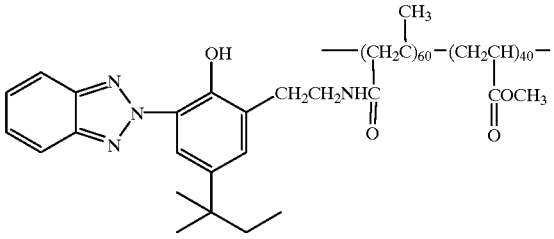

The invention may be practised with any permanent high-boiling solvent known to be useful in the art, such as an aryl ester, such as dibutyl phthalate, diundecyl phthalate; phenols, such as p-dodecyl phenol, 2,4-di-isoamyl phenol; phosphates, such as trihexyl phosphate and tricresyl phosphate; alcohols, such as oleyl alcohol and hexadecanol and amides such as diethyldodecanamide and dibutylacetanilide.

However it is preferred that the high-boiling solvent is a compound having the formula (IV)

(IV)

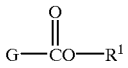

wherein:

$R^1$ is an unsubstituted or substituted alkyl (including aralkyl) or aryl group; and G is an unsubstituted or substituted alkyl (including aralkyl) group.

$R^1$ is preferably an alkyl group, and in particular one having 1 to 20 carbon atoms, such as methyl, ethyl, propyl, butyl, pentyl, octyl, 2-ethylhexyl, decyl, oleyl, linalyl, which may be substituted with one or more groups such as a hydroxy, alkoxy, alkoxycarbonyl or carboxylic ester group or $R^1$ is an aryl group, which may be substituted, for example, with one or more alkyl groups such as a methyl group or $R^1$ is an aralkyl group, such as benzyl.

G is preferably an alkyl group, and in particular one having 1 to 20 carbon atoms, such as methyl, ethyl, propyl, butyl, pentyl, hexyl, heptyl, octyl, nonyl, decyl, undecyl, dodecyl, oleyl, linalyl, cyclohexyl or cyclohexenyl. G may be substituted along the alkyl chain by one or more groups which are the same or different selected from —OH, —$OR^1$, $OCOR^1$, —$COR^1$, —COOH, —$COOR^1$, —CN or halogen, preferably with a hydroxy and/or one or more carboxylic ester groups. Moreover when G is an aralkyl group it may be substituted in the aryl ring with one or more groups, such as with a methoxy group, or on the alkyl part as described above for the alkyl chain.

As used herein the term "high boiling solvent" refers to a solvent having a boiling point above about 100 ° C.

The following solvents further illustrate a preferred embodiment of the invention. It is not to be construed that the present invention is limited to these examples.

S-1

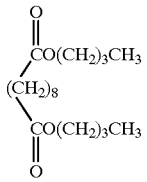

S-2

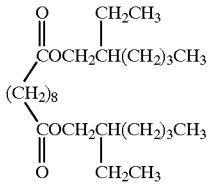

S-3

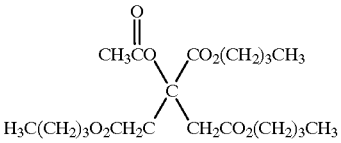

S-4

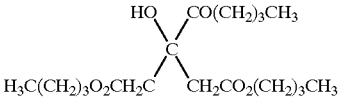

S-5

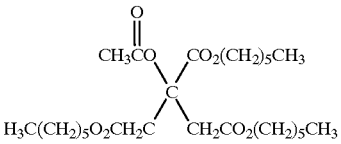

S-6

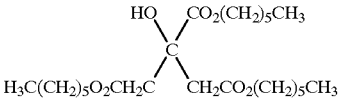

-continued

S-7

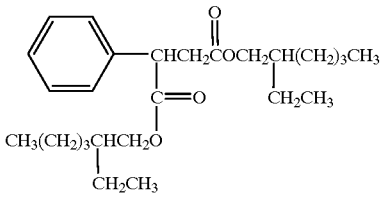

S-8

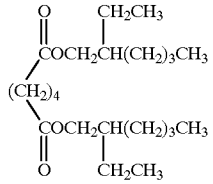

S-9

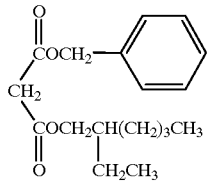

S-10

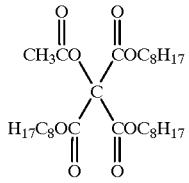

S-11

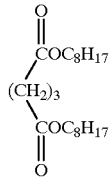

S-12

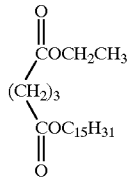

S-13

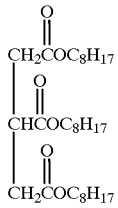

S-14

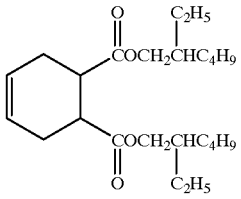

-continued

S-15

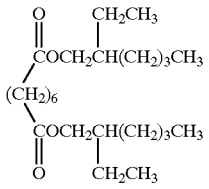

S-16

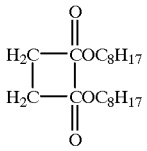

S-17

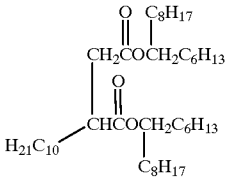

S-18

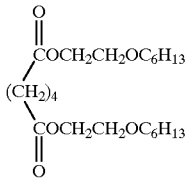

S-19

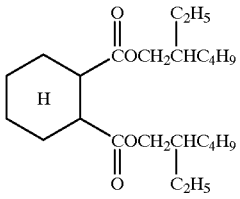

S-20

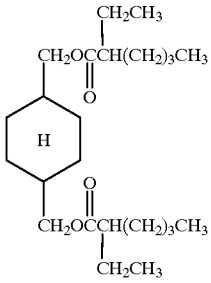

S-21

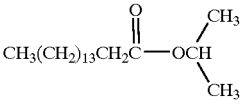

S-22

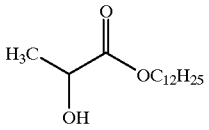

S-23

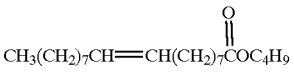

-continued

S-24

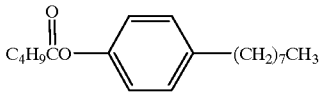

S-25

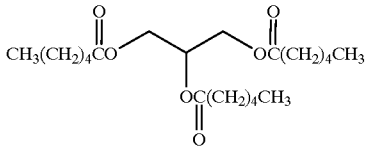

S-26

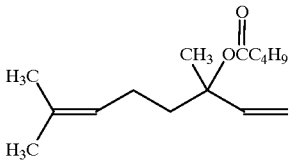

S-27

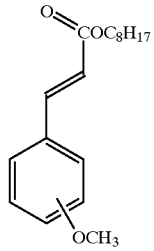

S-28

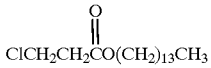

S-29

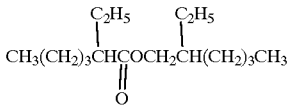

S-30

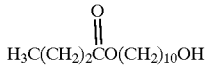

S-31

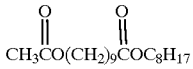

S-32

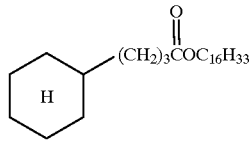

Embodiments of the invention enable lower amounts of coupler and silver to be used by improving the efficiency with which oxidized color developer reacts with the coupler to form dye. They further exhibit reduction of low unwanted side-band absorption, especially unwanted green absorption, providing a color record having improved stability to light, heat and humidity and improved hue.

The dispersion of the "NB couplers", couplers of formula (II) and stabilizers for use in the invention can be prepared by dissolving the materials in one or more high-boiling permanent organic solvents, including those solvents represented by formula (I), with or without a low-boiling or partially water-soluble auxiliary organic solvent. A blend of permanent solvents may be advantageous to optimize the desired features, such as solubility, dye hue, thermal or light stability or the coupling reactivity of the dispersions.

The resulting organic solution may then be mixed with an aqueous gelatin solution and the mixture passed through a mechanical mixing device suitable for high-shear or turbulent mixing generally suitable for preparing photographic emulsified dispersions, such as a colloid mill, homogenizer, microfluidizer, high-speed mixer, ultrasonic dispersing apparatus, blade mixer, device in which a liquid stream is pumped at high pressure through an orifice or interaction chamber, Gaulin mill or blender to form small particles of the organic phase suspended in the aqueous phase. More than one type of device may be used to prepare the dispersions. The auxiliary organic solvent may then removed by evaporation, noodle washing, or membrane dialysis. The dispersion particles preferably have an average particle size of less than 2 $\mu$m, generally from about 0.02 to 2 $\mu$m, more preferably from about 0.02 to 0.5 $\mu$m, especially from about 0.02 to 0.3 $\mu$m. These methods are described in detail in U.S. Pat. Nos. 2,322,027, 2,787,544, 2,801,170, 2,801,171, 2,949,360 and 3,396,027, the disclosures of which are incorporated by reference herein.

Examples of suitable auxiliary solvents which can be used in the present invention include: ethyl acetate, isopropyl acetate, butyl acetate, ethyl propionate, 2-ethoxyethylacetate, 2-(2-butoxyethoxy)ethyl acetate, dimethylformamide, 2-methyl tetrahydrofuran, triethylphosphate, cyclohexanone, butoxyethyl acetate, methyl isobutyl ketone, methyl acetate, 4-methyl-2-pentanol, diethyl carbitol, 1,1,2-trichloroethane and 1,2-dichloropropane.

The aqueous phase of the coupler dispersions for use in the invention preferably comprises gelatin as a hydrophilic colloid. This may be gelatin or a modified gelatin such as acetylated gelatin, phthalated gelatin or oxidized gelatin. Gelatin may be base-processed, such as lime-processed gelatin, or may be acid-processed, such as acid-processed ossein gelatin. Other hydrophilic colloids may also be used, such as a water-soluble polymer or copolymer including, but not limited to poly(vinyl alcohol), partially hydrolyzed poly(vinyl acetate-co-vinyl alcohol), hydroxyethyl cellulose, poly(acrylic acid), poly(1-vinylpyrrolidone), poly (sodium styrene sulfonate), poly(2-acrylamido-2-methane sulfonic acid) and polyacrylamide. Copolymers of these polymers with hydrophobic monomers may also be used.

A surfactant may be present in either the aqueous phase or the organic phase or the dispersions can be prepared without any surfactant present. Surfactants may be cationic, anionic, zwitterionic or non-ionic. Ratios of surfactant to liquid organic solution typically are in the range of 0.5 to 25 wt. % for forming small particle photographic dispersions. In a preferred embodiment of the invention, an anionic surfactant is contained in the aqueous gelatin solution. Particularly preferred surfactants which are employed in the present invention include an alkali metal salt of an alkarylene sulfonic acid, such as the sodium salt of dodecyl benzene sulfonic acid or sodium salts of isopropylnaphthalene sulfonic acids, such as mixtures of di-isopropyl- and tri-isopropylnaphthalene sodium sulfonates; an alkali metal salt of an alkyl sulfuric acid, such as sodium dodecyl sulfate; or an alkali metal salt of an alkyl sulfosuccinate, such as sodium bis (2-ethylhexyl) succinic sulfonate.

In an alternative embodiment, the "NB coupler" and coupler of formula (II) may be dispersed without any high-boiling organic solvent. This could take the form of microprecipitated dispersions of the photographic couplers, prepared by solvent and/or pH shift techniques as described in references: U.K. Patent No. 1,193,349; Research Disclosure 16468, December 1977 pp.75–80; and in U.S. Pat. Nos. 4,970,139; 5,089,380; 5,008,179 and 5,104,776. These no-solvent coupler dispersions could be combined with a separate dispersion containing one or more high boiling solvents, more specifically one which includes at least one solvent of formula (IV), in an aqueous coating solution and the dispersion could also include a stabilizer.

Aqueous dispersions of high-boiling solvents of formulae (IV) can be prepared similarly to the coupler dispersion(s), e.g. by adding the solvent to an aqueous medium and subjecting such mixture to high shear or turbulent mixing as described above. The aqueous medium is preferably a gelatin solution, and surfactants and auxiliary solvents may also be used as described above. Additionally, a hydrophobic additive may be dissolved in the solvent to prevent particle growth as described in U.S. Pat. No. 5,468,604, the disclosure of which is incorporated by reference. The mixture is then passed through a mechanical mixing device such as a colloid mill, homogenizer, microfluidizer, high-speed mixer or ultrasonic dispersing apparatus to form small particles of the organic solvent suspended in the aqueous phase. If an auxiliary solvent is employed, it is then subsequently removed by evaporation, noodle washing, or membrane dialysis. These methods are described in detail in the aforementioned references on dispersion making. The solvent dispersion may be a "blank" dispersion which does not contain any additional photographically useful compounds, or the solvent may be part of a photographically useful compound dispersion.

An aqueous coating solution in accordance with the present invention may then be prepared by combining the cyan coupler dispersion(s) with the separate dispersion of the high-boiling organic solvent of formula (IV). Other ingredients may also be contained in this solution such as silver halide emulsions, dispersions or solutions of other photographically useful compounds, additional gelatin, or acids and bases to adjust the pH. These ingredients may then be mixed with a mechanical device at an elevated temperature (e.g. 30 to 50° C.) for a short period of time (e.g. 5 min to 4 h) prior to coating.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color-developing agent. Thus, as used herein, the term "associated" signifies that the compound is in the silver halide emulsion layer or in an adjacent location where, during processing, it is capable of reacting with silver halide development products.

Suitable laydowns of total coupler are from about 0.10 mmol/m$^2$ to about 1.5 mmol/m$^2$, preferably from about 0.15 mmol/m$^2$ to about 1 mmol/m$^2$, more preferably from about 0.19 mmol/m$^2$ to about 0.55 mmol/m$^2$. The ratio of "NB coupler" to coupler of formula (II) is from about 1:99 to about 99:1, preferably from about 10:90 to about 90:10, more preferably from about 25:75 to about 90:10. Preferably the "NB coupler" and coupler of formula (II) are in equimolar proportions.

The ratio of stabilizer to total coupler is from about 0.01:1 to about 4:1, preferably from about 0.1:1 to about 2:1, more preferably from about 0.5:1 to about 2:1. The ratio of solvent to total coupler is from about 0.2:1 to about 4:1, preferably from about 0.5:1 to about 4:1, more preferably from about 0.5:1 to about 2:1.

The photographic elements comprising coupler dispersions for use in the invention can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler.

The element can be employed with a reflective support, as described in U.S. Pat. No. 5,866,282. The element can contain additional layers, such as filter layers, interlayers, overcoat layers and subbing layers.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230 provides suitable embodiments.

In the following discussion of suitable materials for use in the emulsions and elements of this invention, reference will be made to *Research Disclosure,* September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems and processing methods and agents are described in Sections XV to XX. Certain desirable photographic elements and processing steps, particularly those useful in conjunction with color reflective prints, are described in *Research Disclosure,* Item 37038, February 1995. U.S. Pat. No. 5,558,980 discloses loaded latex compositions, such as poly- and t-butylacrylamides which can be incorporated into any photographic coating in any layer to provide extra dye stability.

Couplers that form magenta dyes upon reaction with oxidized color-developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654 and "Farbkuppler-eine Literature Übersicht," published in Agfa Mitteilungen, Band III, pp. 126–156 (1961). Preferably such couplers are pyrazolones, pyrazolotriazoles or pyrazolobenzimidazoles that form magenta dyes upon reaction with oxidized color-developing agents.

Especially preferred couplers are 1H-pyrazolo[5,1-c]-1,2,4-triazole and 1H-pyrazolo[1,5-b]-1,2,4-triazole. Examples of 1H-pyrazolo[5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465 and 5,023,170. Examples of 1H-pyrazolo[1,5-b]-1,2,4-triazoles can be found in European Patent applications 176,804; 177,765; U.S Pat. Nos. 4,659,652; 5,066,575 and 5,250,400.

Typical pyrazoloazole and pyrazolone couplers are represented by the following formulae:

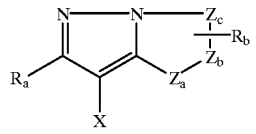

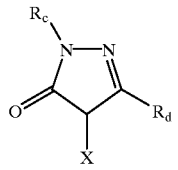

wherein $R_a$ and $R_b$ are independently hydrogen or a substituent; $R_c$ is a substituent (preferably an aryl group); $R_d$ is a substituent (preferably an anilino, carbonamido, ureido, carbamoyl, alkoxy, aryloxy-carbonyl, alkoxycarbonyl, or N-heterocyclic group); X is hydrogen or a coupling-off group; and $Z_a$, $Z_b$, and $Z_c$ are independently a substituted methine group, =N—, =C— or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ is a methine group connected to the group $R_b$.

Specific examples of such couplers are:

M-1

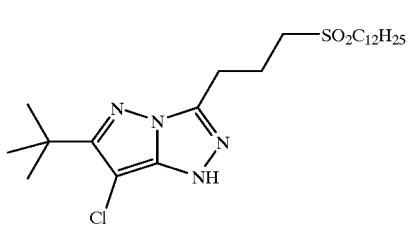

-continued

M-2

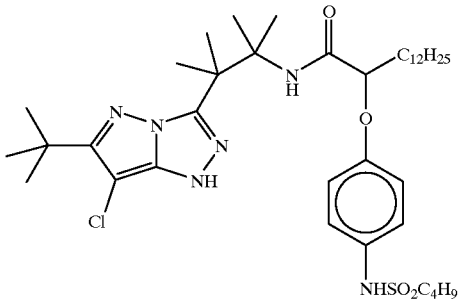

M-3

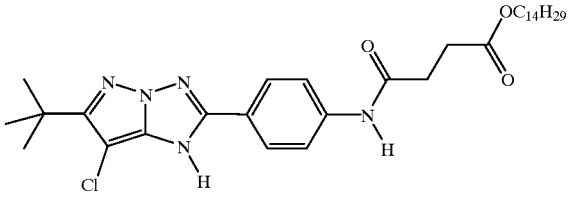

M-4

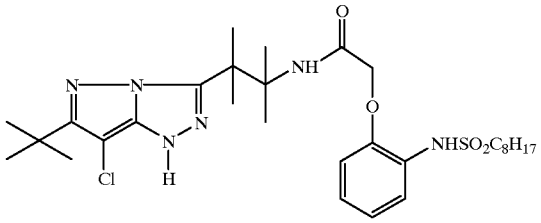

Couplers that form yellow dyes upon reaction with oxidized color-developing agent are described in such representative patents and publications as: U.S. Pat. Nos. 2,298,443, 2,407,210, 2,875,057, 3,048,194, 3,265,506, 3,447,928, 3,960,570, 4,022,620, 4,443,536, 4,910,126 and 5,340,703 and "Farbkuppler-eine Literature Übersicht", published in Agfa Mitteilungen, Band III, pp. 112–126 (1961). Such couplers are typically open chain ketomethylene compounds.

Also preferred are yellow couplers such as described in, for example, European Patent Application Nos. 482,552; 510,535; 524,540; 543,367 and U.S. Pat. No. 5,238,803. For improved color reproduction, couplers which give yellow dyes that cut off sharply on the long wavelength side are particularly preferred (for example, see U.S. Pat. No. 5,360,713).

Typical preferred yellow couplers are represented by the following formulae:

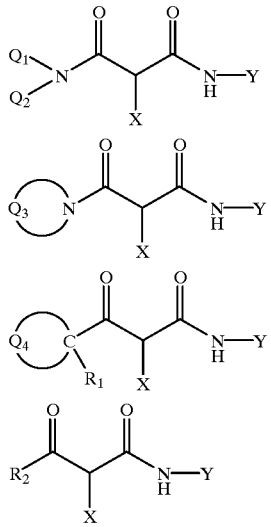

wherein $R_1$, $R_2$, $Q_1$ and $Q_2$ are each a substituent; X is hydrogen or a coupling-off group; Y is an aryl group or a heterocyclic group; $Q_3$ is an organic residue required to form a nitrogen-containing heterocyclic group together with the >N—; and $Q_4$ are nonmetallic atoms necessary to form a 3- to 5-membered hydrocarbon ring or a 3- to 5-membered heterocyclic ring which contains at least one hetero atom selected from nitrogen, oxygen, sulfur and phosphorous in the ring. Particularly preferred is when $Q_1$ and $Q_2$ are each an alkyl group, an aryl group or a heterocyclic group, and $R_2$ is an aryl or tertiary alkyl group.

Preferred yellow couplers have the following structures:

Y-1

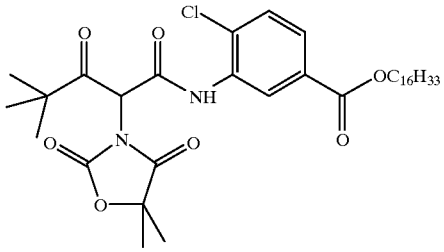

-continued

Y-2

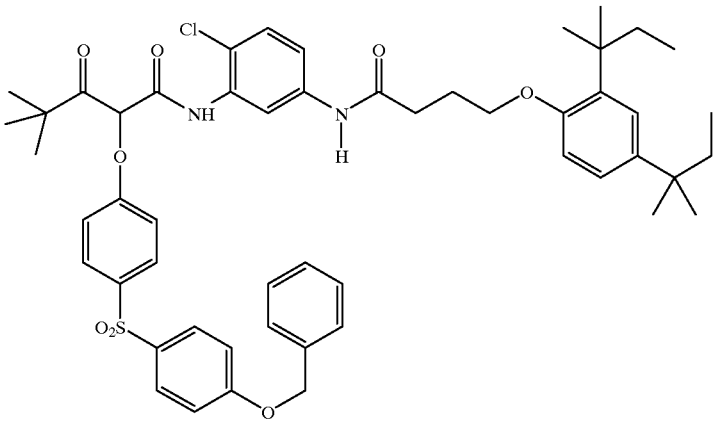

Y-3

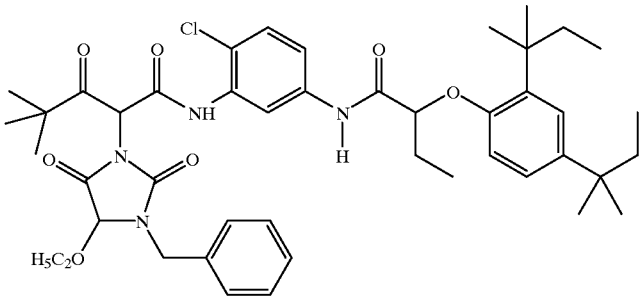

Y-4

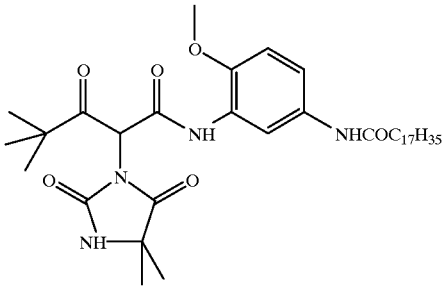

Y-5

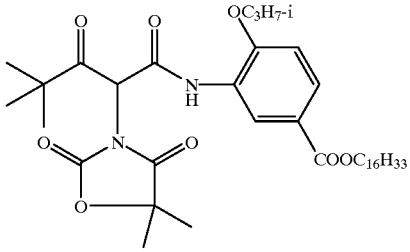

Y-6

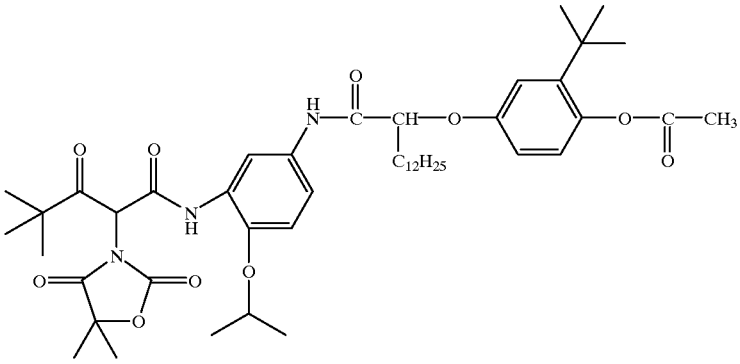

Couplers that form colorless products upon reaction with oxidized color-developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color-developing agent.

Couplers that form black dyes upon reaction with oxidized color-developing agent are described in such representative patents as U.S. Pat. Nos. 1,939,231; 2,181,944; 2,333,106 and 4,126,461; German OLS No. 2,644,194 and German OLS No. 2,650,764. Typically, such couplers are resorcinols or m-aminophenols that form black or neutral products on reaction with oxidized color-developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343 and 5,234,800.

It may be useful to use additional couplers any of which may contain known ballasts or coupling-off groups such as those described in U.S. Pat. Nos. 4,301,235, 4,853,319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608, 4,070,191 and 4,273,861; German Applications DE 2,706,117 and DE 2,643,965; UK Patent No. 1,530,272 and Japanese Application 58-113935. The masking couplers may be shifted or blocked, if desired.

The materials for use in the invention may be used in association with materials that accelerate or otherwise modify the processing steps e.g. of bleaching or fixing to improve the quality of the image. Bleach accelerator releasing couplers such as those described in EP 193,389; EP 301,477 and in U.S. Pat. Nos. 4,163,669, 4,865,956 and 4,923,784, may be useful. Also contemplated is use of the compositions in association with nucleating agents, development accelerators or their precursors (UK Patent Nos. 2,097,140 and 2,131,188); electron transfer agents (U.S. Pat. Nos. 4,859,578 and 4,912,025);

antifogging and anti color-mixing agents such as derivatives of hydroquinones, aminophenols, amines, gallic acid; catechol; ascorbic acid; hydrazides; sulfonamido-phenols and non color-forming couplers.

The materials for use in the invention may also be used in combination with filter dye layers comprising colloidal silver sol or yellow, cyan and/or magenta filter dyes, either as oil-in-water dispersions, latex dispersions or as solid particle dispersions. Additionally, they may be used with "smearing" couplers (e.g. as described in U.S. Pat. Nos. 4,366,237, 4,420,556, 4,543,323 and in EP 96,570) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIRs). DIRs useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in Photographic Science and Engineering, Vol.13, p.174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzo-thiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, tellurotetrazoles or benzisodiazoles. In a preferred embodiment, the inhibitor moiety or group is selected from the following formulae:

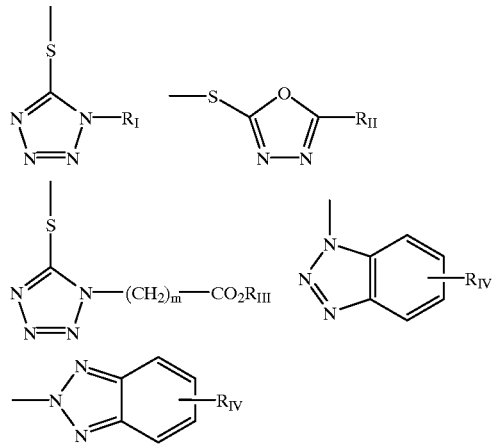

wherein $R_I$ is selected from the group consisting of straight and branched alkyls of from 1 to about 8 carbon atoms, benzyl, phenyl and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group, such as groups using an intramolecular nucleophilic substitution reaction (U.S. Pat. No. 4,248,962); groups utilizing an electron transfer reaction along a conjugated system (U.S. Pat. Nos. 4,409,323, 4,421,845 and 4,861,701 and Japanese Applications 57-188035; 58-98728; 58-209736; 58-209738); groups utilizing ester hydrolysis (German Patent Application (OLS) No. 2,626,315); groups that function as a coupler or reducing agent after the coupler reaction (U.S. Pat. Nos.4,438,193 and 4,618,571) and groups that combine the features described above. It is typical that the timing group is of one of the formulae:

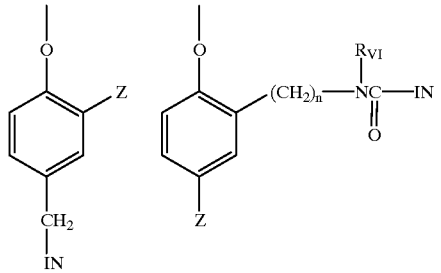

wherein IN is the inhibitor moiety, Z is selected from the group consisting of nitro, cyano, alkylsulfonyl; sulfamoyl (—$SO_2NR_2$) and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers that may be included in photographic light sensitive emulsion layer include, but are not limited to, the following:

D1

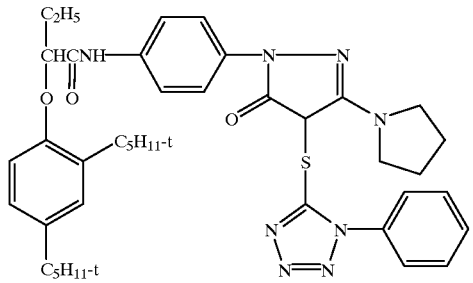

-continued

D2

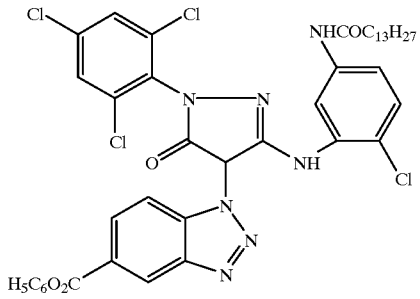

D3

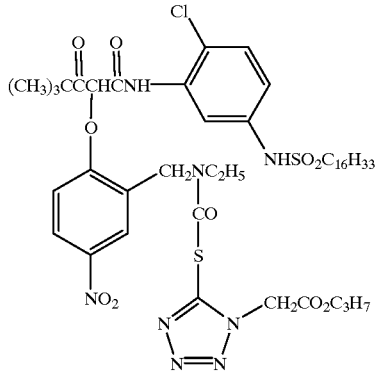

D4

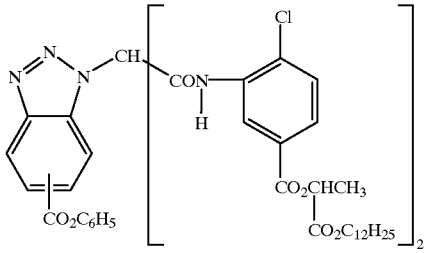

D5

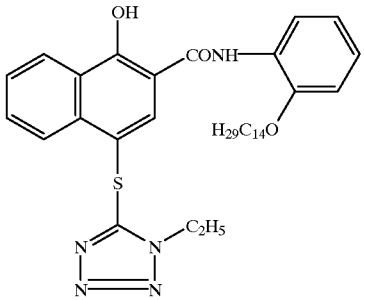

-continued
D6
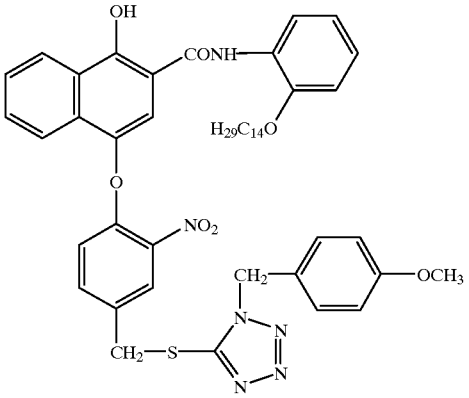
D7
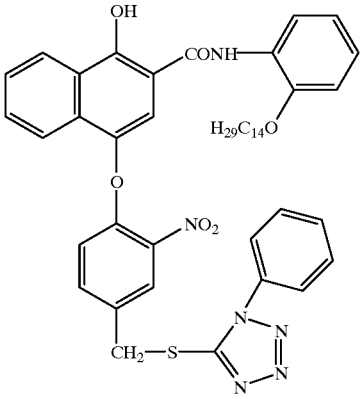
D8
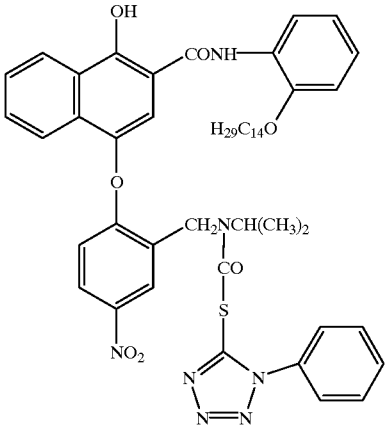
-continued
D9
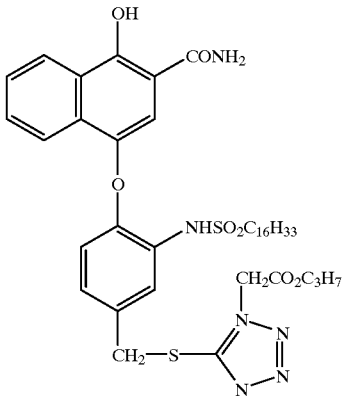
D10
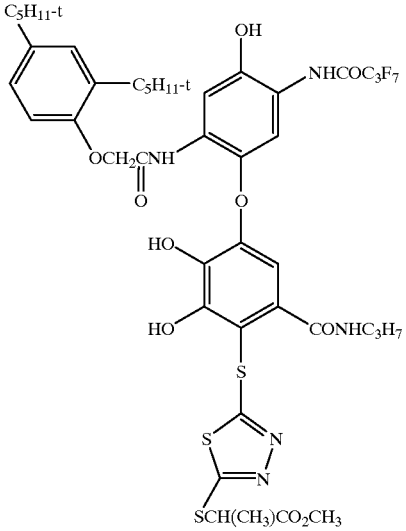
D11
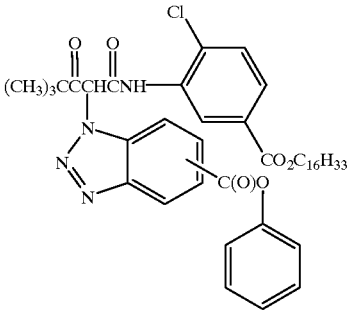

-continued

D12

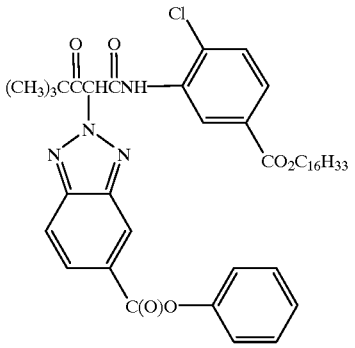

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. Nos. 4,346,165, 4,540,653 and 4,906,559 for example); with ballasted chelating agents such as those in U.S. Pat. No. 4,994,359 to reduce sensitivity to polyvalent cations such as calcium and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Any silver halide combination can be used for the photographic element, such as silver chloride, silver chlorobromide, silver chlorobromoiodide, silver bromide, silver bromoiodide, or silver chloroiodide. In cases where the emulsion composition is a mixed halide, the minor component may be added in the crystal formation or after formation as part of the sensitization or melting. The shape of the silver halide emulsion grain can be cubic, pseudocubic, octahedral, tetradecahedral or tabular. The emulsions may be precipitated in any suitable environment such as a ripening environment, a reducing environment or an oxidizing environment.

Specific references relating to the preparation of emulsions of differing halide ratios and morphologies are Evans U.S. Pat. Nos. 3,618,622; Atwell 4,269,927; Wey 4,414,306; Maskasky 4,400,463, Maskasky 4,713,323; Tufano et al 4,804,621; Takada et al 4,738,398; Nishikawa et al 4,952,491; Ishiguro et al 4,493,508, Hasebe et al 4,820,624; Maskasky 5,264,337 and 5,275,930; House et al 5,320,938 and Chen et al 5,550,013, Edwards et al U.S. Ser. No. 08/362,283 filed on Dec. 22, 1994; U.S. Ser. No. 08/649,391 and U.S. Ser. No. 08/651,193 filed on May 17, 1996.

Emulsion precipitation is conducted in the presence of silver ions, halide ions and in an aqueous dispersing medium including, at least during grain growth, a peptizer. Grain structure and properties can be selected by control of precipitation temperatures, pH and the relative proportions of silver and halide ions in the dispersing medium. To avoid fog, precipitation is customarily conducted on the halide side of the equivalence point (the point at which silver and halide ion activities are equal). Manipulations of these basic parameters are illustrated by the citations including emulsion precipitation descriptions and are further illustrated by Matsuzaka et al U.S. Pat. Nos. 4,497,895, Yagi et al 4,728,603, Sugimoto 4,755,456, Kishita et al 4,847,190, Joly et al 5,017,468, Wu 5,166,045, Shibayama et al EPO 0 328 042 and Kawai EPO 0 531 799.

Reducing agents present in the dispersing medium during precipitation can be employed to increase the sensitivity of the grains, as illustrated by Takada et al U.S. Pat. No. 5,061,614, Takada U.S. Pat. No. 5,079,138 and EPO 0 434 012, Inoue U.S. Pat. No. 5,185,241, Yamashita et al EPO 0 369 491, Ohashi et al EPO 0 371 338, Katsumi EPO 435 270 and 0 435 355 and Shibayama EPO 0 438 791. Conversely, oxidizing agents may be present during precipitation, used as a pretreatment of the dispersing medium (gelatin) or added to the emulsion after grain formation before or during sensitization, in order to improve the sensitivity/fog position of the silver halide emulsion or minimize residual ripening agent, as illustrated by Komatsu et al JP 56-167393 and JP 59-195232, Mifune et al EPA 144 990 and EPA 166 347. Chemically sensitized core grains can serve as hosts for the precipitation of shells, as illustrated by Porter et al U.S. Pat. Nos. 3,206,313 and 3,327,322, Evans 3,761,276, Atwell et al 4,035,185 and Evans et al 4,504,570.

Dopants (any grain occlusions other than silver and halide ions) can be employed to modify grain structure and properties. Periods 3–7 ions, including Group VIII metal ions (Fe, Co, Ni and platinum metals (pm) Ru, Rh, Pd, Re, Os, Ir and Pt), Mg, Al, Ca, Sc, Ti, V, Cr, Mn, Cu Zn, Ga, As, Se, Sr, Y, Mo, Zr, Nb, Cd, In, Sn, Sb, Ba, La, W, Au, Hg, Tl, Pb, Bi, Ce and U can be introduced during precipitation. The dopants can be employed (a) to increase the sensitivity of either (a1) direct positive or (a2) negative working emulsions, (b) to reduce (b1) high or (b2) low intensity reciprocity failure, (c) to (c1) increase, (c2) decrease or (c3) reduce the variation of contrast, (d) to reduce pressure sensitivity, (e) to decrease dye desensitization, (f) to increase stability, (g) to reduce minimum density, (h) to increase maximum density, (i) to improve room light handling and (j) to enhance latent image formation in response to shorter wavelength (e.g. X-ray or gamma radiation) exposures. For some uses any polyvalent metal ion (pvmi) is effective. The selection of the host grain and the dopant, including its concentration and, for some uses, its location within the host grain and/or its valence can be varied to achieve aim photographic properties, as illustrated by B. H. Carroll, "Iridium Sensitization: A Literature Review", *Photographic Science and Engineering,* Vol. 24, No. 6 November/December 1980, pp. 265–267.

Dopants can be added in conjunction with addenda, antifoggants, dye and stabilizers either during precipitation of the grains or post precipitation, possibly with halide ion addition. These methods may result in dopant deposits near or in a slightly subsurface fashion, possibly with modified emulsion effects, as illustrated by Ihama et al U.S. Pat. Nos. 4,693,965; Shiba et al 3,790,390; Habu et al 4,147,542; Hasebe et al EPO 0 273 430 Ohshima et al EPO 0 312 999 and Ogawa U.S. Statutory Invention Registration H760.

Desensitizing, contrast increasing or reciprocity failure reducing ions or complexes are typically dopants which function to trap photogenerated holes or electrons by introducing additional energy levels deep within the bandgap of the host material. Examples include, but are not limited to, simple salts and complexes of Groups 8–10 transition metals (e.g. rhodium, iridium, cobalt, ruthenium, and osmium) and transition metal complexes containing nitrosyl or thionitrosyl ligands as described by McDugle et al U.S. Pat. No. 4,933,272. Specific examples include $K_3RhCl_6$, $(NH_4)_2Rh(Cl_5)H_2O$, $K_2IrCl_6$, $K_3IrCl_6$, $K_2IrBr_6$, $K_2IrBr_6$, $K_2RuCl_6$, $K_2Ru(NO)Br_5$, $K_2Ru(NS)Br_5$, $K_2OsCl_6$, $Cs_2Os(NO)Cl_5$ and $K_2Os(NS)Cl_5$. Amine, oxalate, and organic ligand complexes or ions of these or other metals as disclosed in Olm et al U.S. Pat. Nos. 5,360,712 and 5,457,021 and in Kuromoto et al U.S. Pat. No. 5,462,849 are also contemplated. Specific examples include $[IrCl_4(\text{ethylenediamine})_2]^{-1}$, $[IrCl_4(CH_3SCH_2CH_2SCH_3)]^{-1}$, $[IrCl_5(\text{pyrazine})]^{-2}$, $[IrCl_5(\text{chloropyrazine})]^{-2}$, $[IrCl_5(\text{N-methylpyrazinium})]^{-1}$, $[IrCl_5(\text{pyrimidine})]^{-2}$, $[IrCl_5(\text{pyridine})]^{-2}$, $[IrCl_4(\text{pyridine})_2]^{-1}$, $[IrCl_4(\text{oxalate})_2]^{-3}$, $[IrCl_5(\text{thiazole})]^{-2}$, $[IrCl_4(\text{thiazole})_2]^{-1}$, $[IrCl_4(\text{2-bromothiazole})_2]^{-1}$, $[IrCl_5(\text{5-methylthiazole})]^{-2}$, $[IrBr_5(\text{thiazole})]^{-2}$ and $[IrBr_4(\text{thiazole})_2]^{-1}$.

In a specific, preferred form it is contemplated to employ as a dopant a hexacoordination complex satisfying the formula: $[ML_6]^n$ where M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$, $Pt^{+4}$; $L_6$ represents six coordination complex ligands which can be independently selected, provided that least four of the ligands are anionic ligands and at least one (preferably at least 3 and optimally at least 4) of the ligands is more electro-negative than any halide ligand and n is −2, −3 or −4.

The following are specific illustrations of dopants capable of providing shallow electron traps:

| | | | |
|---|---|---|---|
| $[Fe(CN)_6]^{-4}$ | SET-1 | $[Ru(CN)_6]^{-4}$ | SET-2 |
| $[Os(CN)_6]^{-4}$ | SET-3 | $[Rh(CN)_6]^{-3}$ | SET-4 |
| $[Ir(CN)_6]^{-3}$ | SET-5 | $[Fe(\text{pyrazine})(CN)_5]^{-4}$ | SET-6 |
| $[RuCl(CN)_5]^{-4}$ | SET-7 | $[OsBr(CN)_5]^{-4}$ | SET-8 |
| $[RhF(CN)_5]^{-3}$ | SET-9 | $[IrBr(CN)_5]^{-3}$ | SET 10 |
| $[FeCO(CN)_5]^{-3}$ | SET-11 | $[RuF_2(CN)_4]^{-4}$ | SET-12 |
| $[OsCl_2(CN)_4]^{-4}$ | SET-13 | $[RhI_2(CN)_4]^{-3}$ | SET-14 |
| $[IrBr_2(CN)_4]^{-3}$ | SET-15 | $[Ru(CN)_5(OCN)]^{-4}$ | SET-16 |
| $[Ru(CN)_5(N_3)]^{-4}$ | SET-17 | $[Os(CN)_5(SCN)]^{-4}$ | SET-18 |
| $[Rh(CN)_5(SeCN)]^{-3}$ | SET-19 | $[Ir(CN)_5(HOH)]^{-2}$ | SET-20 |
| $[Fe(CN)_3Cl_3]^{-3}$ | SET-21 | $[Ru(CO)_2(CN)_4]^{-1}$ | SET-22 |
| $[Os(CN)Cl_5]^{-4}$ | SET-23 | $[Co(CN)_6]^{-3}$ | SET-24 |
| $[Ir(NCS)_6]^{-3}$ | SET-25 | $[In(NCS)_6]^{-3}$ | SET-26 |
| $[GA(NCS)_6]^{-3}$ | SET-27 | | |

It is additionally contemplated to employ oligomeric coordination complexes to increase speed, as taught by Evans et al U.S. Pat. No. 5,024,931, the disclosure of which is here incorporated by reference.

The dopants are effective in conventional concentrations, where concentrations are based on the total silver, including both the silver in the grains and the silver in epitaxial protrusions. Generally shallow electron trap forming dopants are contemplated to be incorporated in concentrations of at least $1\times10^{-8}$ mole per silver mole up to their solubility limit, typically up to about $10^{-3}$ mole per silver mole. Preferred concentrations are in the range of from about $10^{-6}$ to $10^{-4}$ mole per silver mole. When used in the presence of other deep electron trapping dopants, such as $Cs_2Os(NO)Cl_5$, preferred concentrations of shallow electron traps may approach $10^{-8}$ to $10^{-7}$ mole per silver mole. Combinations of deep and shallow electron trapping dopants may be used to increase contrast as taught by MacIntyre and Bell in U.S. Pat. No. 5,597,686 and by Bell in U.S. Pat. Nos. 5,252,451, 5,256,530, 5,385,817, 5,474,888, 5,480,771 and 5,500,335. It is, of course, possible to distribute the dopant so that a portion of it is incorporated in grains and the remainder is incorporated in the silver halide epitaxial protrusions.

Emulsion addenda that adsorb to grain surfaces, such as antifoggants, stabilizers and dyes can also be added to the emulsions during precipitation. Precipitation in the presence of spectral sensitizing dyes is illustrated by Locker U.S. Pat. Nos. 4,183,756, Locker et al 4,225,666, Ihama et al 4,683,193 and 4,828,972, Takagi et al 4,912,017, Ishiguro et al 4,983,508, Nakayama et al 4,996,140, Steiger 5,077,190, Brugger et al 5,141,845, Metoki et al 5,153,116, Asami et al EP 287,100 and Tadaaki et al EP 301,508. Non-dye addenda are illustrated by Klotzer et al U.S. Pat. Nos. 4,705,747, Ogi et al 4,868,102, Ohya et al 5,015,563, Bahnmuller et al 5,045,444, Maeka et al 5,070,008 and Vandenabeele et al EP 392,092. Water soluble disulfides are illustrated by Budz et al 5,418,127.

Chemical sensitization of the materials in this photographic element is accomplished by any of a variety of known chemical sensitizers. The emulsions described herein may or may not have other addenda such as sensitizing dyes, supersensitizers, emulsion ripeners, gelatin or halide conversion restrainers present before, during or after the addition of chemical sensitization.

The use of sulfur, sulfur plus gold or gold only sensitizations are very effective sensitizers. Typical gold sensitizers are chloroaurates, aurous dithio-sulfate, aqueous colloidal gold sulfide or aurous bis(1,4,5-trimethyl-1,2,4-triazolium-3-thiolate) tetrafluoroborate (e.g. U.S Pat. No. 5,049,485). Sulfur sensitizers may include thiosulfate, thio-cyanate, N,N'-carbothioyl-bis(N-methylglycine) or 1,3-dicarboxymethyl-1,3-dimethyl-2-thiourea sodium salt.

The addition of one or more antifoggants as stain reducing agents is also common in silver halide systems. Tetrazaindenes, such as 4-hydroxy-6-methyl-(1,3,3a,7)-tetrazaindene, are commonly used as stabilizers. Also useful are mercaptotetrazoles such as 1-phenyl-5-mercaptotetrazole or acetamido-1- phenyl-5-mercaptotetrazole. Arylthiosulfonates, such as tolylthiosulfonate (optionally used with arylsulfinates such as tolylsulfinate) or esters thereof are especially useful (e.g. U.S. Pat. No. 4,960,689). The use of water-soluble disulfides is illustrated in U.S. Ser. No. 08/729,127 filed Oct. 11, 1996.

Especially preferred for use in the present invention are tabular grain silver halide emulsions. Specifically contemplated tabular grain emulsions are those in which greater than 50 percent of the total projected area of the emulsion grains are accounted for by tabular grains having a thickness of less than 0.3 micrometers (0.5 micrometers for blue sensitive emulsion) and an average tabularity (T) of greater than 25 (preferably greater than 100), where the term "tabularity" is employed in its art recognized usage as $T=ECD/t^2$ wherein ECD is the average equivalent circular diameter of the tabular grains in micrometers and t is the average thickness in micrometers of the tabular grains.

The average useful ECD of photographic emulsions can range up to about 10 micrometers, although in practice emulsion ECDs seldom exceed about 4 micrometers. Since both photographic speed and granularity increase with increasing ECDs, it is generally preferred to employ the smallest tabular grain ECDs compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky in U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e. emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color-developing agent to reduce developable silver halide and oxidize the color-developing agent. Oxidized color-developing agent in turn reacts with the coupler to yield a dye.

With negative-working silver halide, the processing step described above provides a negative image. The described elements can be processed in the known Kodak C-41™ color process as described in The British Journal of Photography Annual of 1988, pp 191–198. Where applicable, the element may be processed in accordance with color print processes such as the Kodak RA-4™ process of Eastman Kodak Company as described in the British Journal of Photography Annual of 1988, pp 198–199. Such negative working emulsions are typically sold with instructions to process using a color negative method such as the Kodak C-4™ or RA-4™ process. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as Kodak E-6™. Alternatively, a direct positive emulsion can be employed to obtain a positive image.

The multicolor photographic elements of the invention may be processed alternatively in a developer solution that will provide reduce processing times of one minute or less (dry to dry), and particularly reduced color development times of less than about 25 seconds, such that all color records are fully developed with aim sensitometry.

Preferred color-developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamnido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing or bleach-fixing, to remove silver or silver halide, washing and drying.

The coupler dispersions may be coated with emulsions to form photographic elements at very low levels of silver (less than 100 mg/m$^2$). Reasons for doing this include reducing cost, reducing the thickness of silver halide emulsion layers to gain sharpness advantages and reducing the environmental impact during and after processing.

One class of low silver photographic material is color material intended for redox amplification processes wherein the developed silver acts as a catalyst to the formation of the dye image. This process can take place in a low volume thin processor, such as a low volume thin tank (LVTT), for example, as disclosed in U.S. Pat. No. 5,436,118. Redox amplification processes have been described for example in GB 1,268,126, GB 1,399,481, GB 1,403,418, GB 1,560,572, U.S. Pat. Nos. 3,748,138, 3,822,129 and 4,097,278. In such processes, color materials are developed to produce a silver image (which may contain only small amounts of silver) and are then treated with a redox amplifying solution (or a combined developer-amplifier) to form a dye image.

The following examples illustrate the invention but are in no way as to be construed as being limiting thereof.

EXAMPLES

Preparative Examples

The cyan couplers of formula (I) of this invention can be prepared by reacting alkyl or aryl acid chlorides with an appropriate aminophenol, such as 2-amino-5-nitrophenol or 2-amino-4-chloro-5-nitrophenol, to form the 2-carbonamido coupler intermediates. The nitro group of the coupler intermediate can then be reduced and a separately prepared sulfone-containing ballast can be attached thereto by conventional procedures.

The cyan couplers of formula (II) can be prepared by reducing a nitrophenol to the corresponding aminophenol and then combining it with a suitably substituted alkyl acid chloride.

The syntheses of coupler compounds IC-7 and IIC-3 will further illustrate the invention.

Example 1

Synthesis of a Coupler of Formula (1) (IC-7)

A. Preparation of the phenolic coupler intermediate

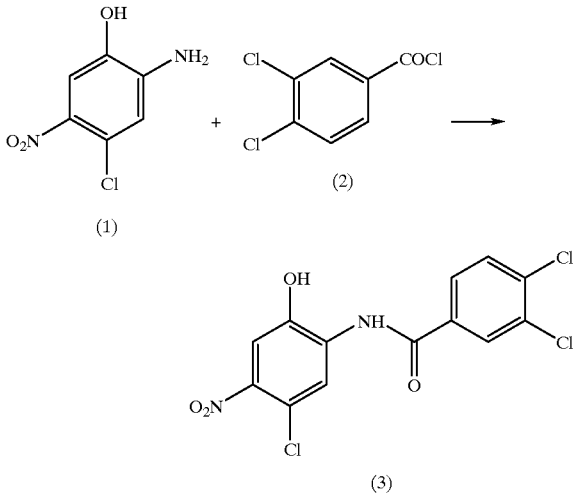

3,4-dichlorobenzoyl chloride (2) (38.0 g, 0.18 mol) was added to a stirred slurry of 2-amino-4-chloro-5-nitro-phenol (1) (34.0 g, 0. 18 mol) in ethyl acetate (250 ml) and the mixture refluxed for 2 h. After cooling the precipitate was filtered and then slurried in hot ethyl acetate (200 ml) and filtered again to give 50 g (77%) nitrophenol (3).

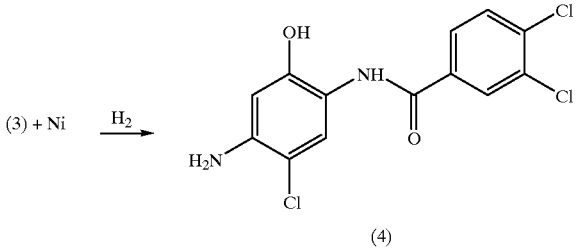

The nitrophenol (3) (36.0 g, 0.1 mol) was dissolved in ethyl acetate (250 ml) and dimethylformamide (DMF) (50 ml). The solution was hydrogenated over Raney Nickel at 3040 kPa (30 atm)/25° C. for 15 h. The catalyst was removed by filtration through a pad of Kieselguhr and the ethyl acetate removed in vacuo. The residual solution of aminophenol (4) in DMF was poured on to an ice/water mixture (1.5 l) to precipitate aminophenol (4) (27 g, yield 84%), which was collected by filtration and dried. This was stored under a blanket of nitrogen while the sulphone-containing ballast was prepared.

B. Preparation of the sulfone acid chloride ballast

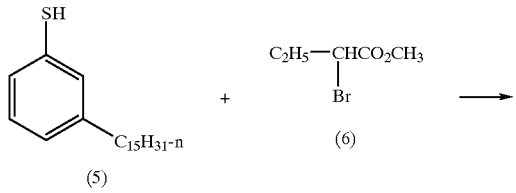

-continued

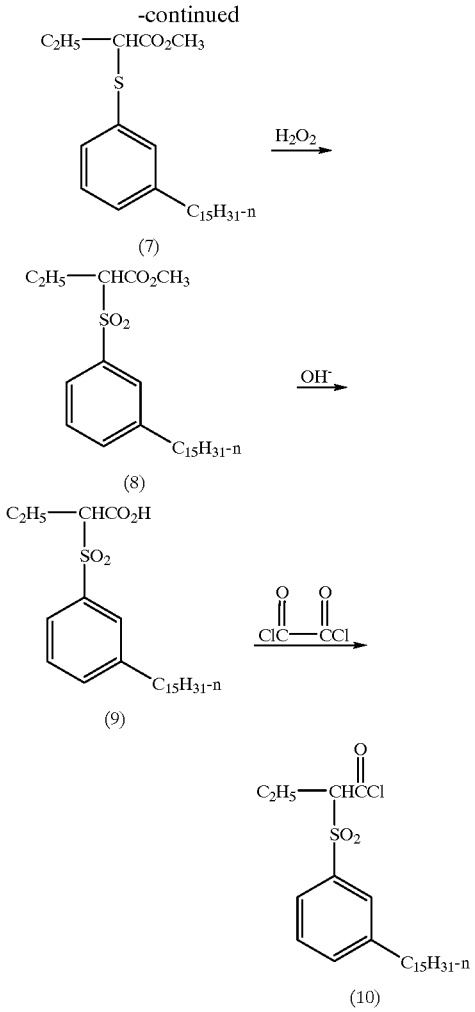

To a well-stirred solution of m-pentadecylphenylthiol (5) (40 g, 0.13 mol) and methyl α-bromobutyrate (6) (27 g, 0.15 mol) in acetone (500 ml) was added potassium carbonate (104 g, 0.75 mol). The mixture was heated on a steam bath and refluxed for 1 h. After cooling to room temperature the insoluble matter was filtered off. The filtrate was poured into water and extracted with ethyl acetate. The ethyl acetate was removed under reduced pressure and the residual crude product mixture dissolved in ligroin. The solution was chromatographed through a short silica gel column, eluting first with ligroin and finally with 50% ligroin-ethylene di-chloride mixture. The fractions containing the pure product were combined and the solvent removed to give 43 g ballast intermediate (7) as a colorless oil.

The intermediate (7) was taken up in acetic acid (300 ml), cooled to 10–15° C., and treated with 30% hydrogen peroxide (23 ml). The mixture was stirred at room temperature for 0.5 h and then heated on the steam bath for 1 h. Upon standing at room temperature overnight the product crystallized out. The pure white solid crystals were collected to give 41.5 g sulfone ballast ester (8).

The ester (8) was dissolved in methanol (200 ml) and THF (200 ml). The solution was then heated with sodium hydroxide (18 g) dissolved in water (150 ml). After stirring at room temperature for 1 h, the mixture was poured into dilute hydrochloric acid. The white solid that precipitated out was collected, washed with water and dried to give 40 g sulfone ballast acid (9) as a white solid.

To a solution of (9) (13.6 g, 0.031 mol) in ethylene dichloride (100 ml) was added with stirring (oxalyl chloride (11.4 g, 0.09 mol) and DMF (5 drops). After stirring at room temperature for 2 h, the mixture was concentrated to give 13.9 g ballast acid chloride (10) as an oil.

C. Preparation of Coupler Compound IC-7

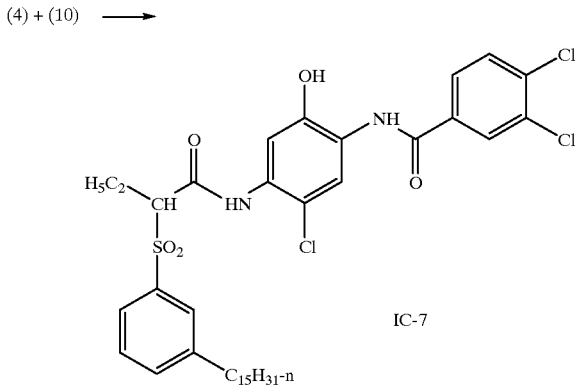

The aminophenol (4) (9.95 g, 0.03 mol) was mixed with THF (125 ml) and dimethylaniline (3.62 g, 0.03 mol) was added. The mixture was stirred and cooled to 5° C., before adding a solution of the ballast acid chloride (10) (13.9 g, 0.031 mol) in THF (25 ml) dropwise with stirring, keeping the internal temperature below 10° C. The initial yellow suspension gave place to a brown solution which was stirred overnight at ambient temperature. The solution was then evaporated in vacuo, and the residual brown oil dissolved in ethyl acetate (250 ml) and washed with 10% hydrochloric acid (375 ml) followed by brine (375 ml) and dried over magnesium sulphate. The resulting light brown solution was evaporated in vacuo and the residue recrystallised from acetonitrile (200 ml). The required product was obtained as a pinkish-beige powder (21.4 g, 95%). The structure was confirmed by $^1$HNMR and elemental analysis.

Calcd.: C, 60.67; H, 6.57; Cl, 14.14; N, 3.72; S, 4.26;
Found: C, 60.52; H, 6.55; Cl, 14.11; N, 3.75; S, 4.21.

Example 2

Synthesis of a Coupler of Formula (II) (IIC-3)

D. Preparation of the aminophenol

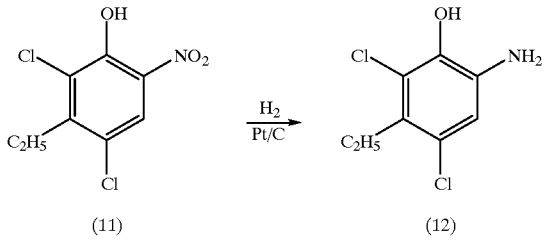

The nitrophenol (11) (64.0 g, 0.27 mol) was slurried in isopropanol (50 ml) to which was added 0.14 g platinum/carbon; the mixture was stirred and hydrogenated at 690 kPa (100 psi) for 5 h at 60° C., then at 3100 kPa (450 psi) for 2 h at 60° C. The mixture was filtered while hot to remove the catalyst, and cooled to 40° C. Sodium dithionite (1.32 g) was added to the filtrate which was stirred at 40° C. for 30 min. Water (100 ml) was added, whilst maintaining the temperature at 35/37° C. and stirred for 45 min. A final quantity of water (150 ml) was then added and the mixture was cooled to 0–5° C., then filtered, washed with water and the amine, (12) (53.9 g, 96% yield) was dried.

E. Preparation of the Ballast Acid Chloride.

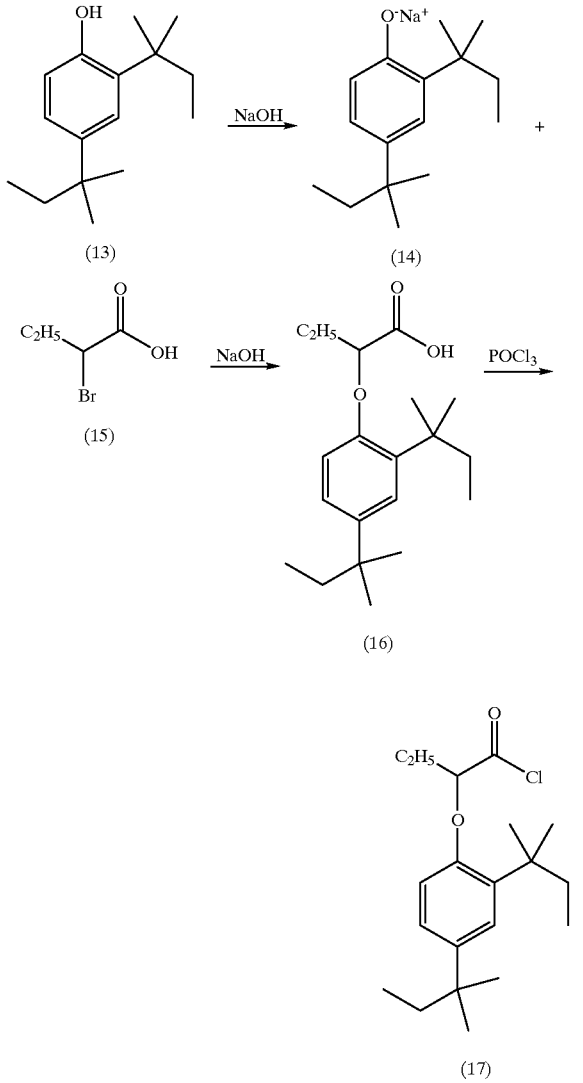

2,4-di-t-amylphenol (47.0 g, 0.2 mol) was added to a mixture of sodium hydroxide (9.8 g, 0.246 mol) in heptane (200 ml) under nitrogen at 70° C. and heated to reflux. Then water was distilled off for 3 h to form the salt (14) which was used in situ. The mixture was cooled to 55° C. and, whilst under nitrogen, further sodium hydroxide (13.4 g, 0.34 mol) was added. α-Bromobutyric acid (15) (40.2 g, 0.24 mol) was added over 30 min while maintaining the temperature at 55° C. When addition of (15) was completed, the mixture was heated at 60° C. for a further 2 h and then heated to 70° C. and washed first with water (65 ml) followed by a 35% solution sulfuric acid (18 g) and separated at 70° C. The heptane phase was washed with water (24 ml) followed by 35% sulfuric acid (30.4 g), which was also separated at 70° C., washed twice with water (44 ml each), with separation each time, and then distilled to remove any remaining water as the azeotrope and some of the heptane. The mixture of acid (16) in heptane was thus concentrated to a weight of 122 g.

Dimethylacetamide (18.6 g, 0.2 mol) was added to the stirred heptane solution of acid (16) and heated to 55° C. Phosphorus oxychloride (30 g, 0.2 mol) was then added over 15 min at 55° C. and, when addition was complete, stirring continued at 55° C. for 5 h, the mixture then warmed to 60° C. and stirring stopped. The mixture was allowed to stand and settle into two layers; the lower layer was separated out and the upper organic layer kept. This contained the acid chloride (17) (98% yield based on the acid (16) in approx. 55% solution).

F. Preparation of Coupler Compound IIC-3

(17) + (12) ⟶

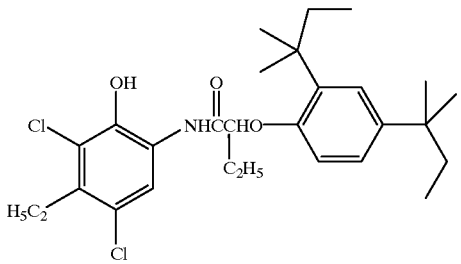

(IIC-3)

The amine (12) (20.6 g, 0.1 mol) was placed in a flask to which had been added water (28 ml), heptane (100 ml) and toluene (20 ml) and stirred under a nitrogen blanket. A 55% solution (68.7 g) acid chloride (17) (equivalent to 37.8 g, 0.11 mol) in heptane was added over 10 min, ensuring that the temperature did not rise above 40° C. The mixture was heated to 82° C. and stirred at this temperature for 1 h. The solution was cooled to 55° C., anhydrous sodium acetate (9.9 g) added and then heated to 82° C. for 15 min. Stirring was stopped, the mixture allowed to stand for 5 min and the lower aqueous layer decanted. The upper, organic layer was washed each time at 82° C. with: (i)citric acid (1.4 g) in water (25 ml) and decanted; (ii) with sodium acetate (2.8 g) in water (25 ml) and decanted; (iii) two water washes (25 ml each) and decanted each time. The organic layer was distilled to remove much of the solvent and achieve a mixture weight of 127 g. The mixture was filtered hot, then, while being stirred, the filtrate was cooled gradually from 78° C. to 50° C. over 4 h, then ice-cold for 2 h. The resulting slush was filtered and washed with cold heptane (50 ml) and dried, providing 48.3 g of IIC-3 (95% yield based on amine (12)).

All the stabilizers of formula (III) and the solvents of formula (IV) used in this invention were available either commercially or prepared using standard techniques.

Example 3

Determination of "NB Couplers"

Using a procedure such as described in J. Bailey, JCS Perkin 1, 1977, 2047, the dyes of the couplers in Table I below were prepared by coupling with 4-amino-3-methyl-N-ethyl-N-(2-methanesulfonamidoethyl)aniline sesquisulfate hydrate, then purified by either crystallisation or chromatographic techniques.

A 3% w/v solution of di-n-butyl sebacate S-1 was made with ethyl acetate and from this solution a 3% w/v solution of the dye was prepared. If the dye were insoluble, dissolution was achieved by the addition of some methylene chloride. The solution was filtered and 0.1–0.2 ml was applied to a clear polyethylene-terephthalate support (approx. 4 cm×4 cm) and spun at 4,000 rev/min using the Spin-Coating equipment, Model No. EC101, available from Headway Research Inc., Garland Tex. The normalised (density of 1.00) transmission spectra of the so-prepared dye samples were then recorded. The transmission spectrum of each dye in acetonitrile was also measured and normalized to a density of 1.00.

The $\lambda_{max}$ values, "half bandwidth" (HBW), and "left bandwidth" (LBW) values for each normalized spectrum are reported in Table 1 below. The wavelength of maximum absorption was recorded as the $\lambda_{max}$. The HBW was obtained by subtracting the wavelength at the point on the left side (short wavelength) of the absorption band where the normalized density is 0.50 from the wavelength at the point on the right side (long wavelength) of the absorption band where the normalized density is 0.50. The LBW was obtained by subtracting the wavelength at the point on the left side (short wavelength) of the absorption band where the normalized density is 0.50 from $\lambda_{max}$.

TABLE 1

Spin-Coating (SC) and Solution-acetonitrile (soln.)

| Dye | $\lambda_{max}$ Soln. | $\lambda_{max}$ SC | HBW Soln. | HBW SC | LBW Soln. | LBW SC | LBW Soln. - LBW SC |
|---|---|---|---|---|---|---|---|
| IC-7 | 637 | 619 | 123 | 73 | 66 | 34 | 32 |
| IC-35 | 633 | 624 | 123 | 77 | 64 | 36 | 28 |
| CC-1 | 628 | 631 | 121 | 126 | 63 | 62 | 1 |
| CC-2 | 626 | 634 | 124 | 126 | 64 | 63 | 1 |

It will be seen that the $\lambda_{max}$ values of IC-7 and IC-35 upon spin-coating are lower than those of the comparison couplers CC-1 and CC-2. However in solution, each of the four dyes has similar LBW values. Upon spin-coating, the LBW values of the dyes from IC-7 and IC-35 are 32 nm and 28 nm less than the LBW values of the same dyes in solution, respectively. These couplers thus meet the criterion defined for an "NB coupler". The spin-coating LBW values for the dyes from comparison couplers CC-1 and CC-2 are different from the solution LBW values by only 1 nm, and therefore are not "NB couplers". Narrow LBW values in the dyes for use in the invention give less unwanted absorption in the green region of the spectrum and are very desirable for color reproduction.

CC-1

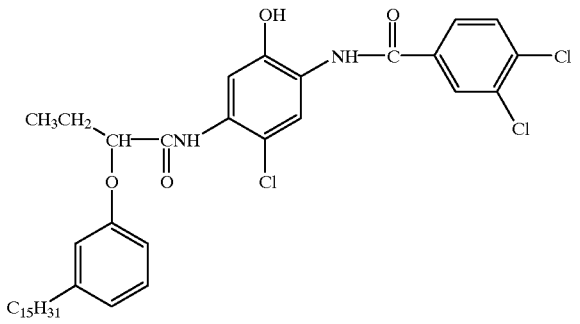

-continued

CC-2

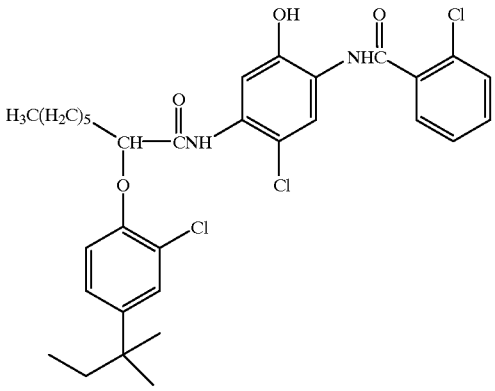

PHOTOGRAPHIC EXAMPLES

Dispersion Examples

Example 4

The coupler solutions were prepared by heating to 140° C. mixtures of a coupler of formula (I), a coupler of formula (II), a stabilizer of formula (III) and a solvent in the combinations shown below in Table 2, which also includes comparative dispersions.

For dispersion 1, a gelatin solution was made from 24.8 g decalcified gelatin in demineralised water and 29.5 g 10% solution of surfactant Alkanol XC™ which was heated to 80° C. For each of dispersions 3 and 4, a gelatin solution was made from 18.0 g decalcified gelatin in demineralised water and 18 g 10% solution Alkanol XC™, which was heated to 80° C. For each of the other dispersions a gelatin solution was made from 21 g decalcified gelatin in demineralised water and 24.8 g 10% solution of surfactant Alkanol XC™, also heated to 80° C. In each case, the amount of water incorporated in the gelatin solution was such that the total combined weight of the coupler solution and gelatin solution would be 300 g.

In each case the coupler and gelatin solutions were combined and mixed for 4 min at 10000 rev/min using a Polytron (a rotor stator device manufactured by Kinematica instruments, Switzerland). The mixture was then homogenised by passing it once through an M-110F Microfluidizer (manufactured by Microfluidics Corp.) at 55° C. and 62,046 kPa (9000 psi) pressure. Sample No. 10 made with solvent J, showed the largest droplet size of about 0.34 μm (measured by a turbidimetric technique). All the other dispersions had mean droplet sizes of between 0.2 and 0.3 μm. Each dispersion was placed in cold storage until ready for coating.

TABLE 2

Dispersion coupler solutions

| Sample No. | Coupler I | Wt. I (g) | Coupler II | Wt. II (g) | Stabilizer ST | Wt. ST (g) | Solvent S | Wt. S (g) |
|---|---|---|---|---|---|---|---|---|
| 1 | — | — | IIC-3 | 24.8 | ST-1 | 16.0 | A | 24.3 |
| 2 | CC-3 | 10.9 | " | 10.9 | " | 15.1 | S-1 | 21.0 |
| 3 | IC-7 | 20.7 | — | — | " | 12.4 | " | 11.9 |
| 4 | " | 18.0 | — | — | L | 10.8 | F | 5.4 |
| | | | | | | | J | 10.8 |
| 5 | " | 4.2 | IIC-3 | 16.8 | ST-1 | 21.0 | S-1 | 12.6 |
| 6 | " | 16.8 | " | 4.2 | " | 21.0 | " | 12.6 |
| 7 | " | 16.8 | " | 4.2 | " | 21.0 | " | 29.4 |
| 8 | " | 10.9 | " | 10.9 | " | 15.1 | " | 21.0 |
| 9 | " | 10.9 | " | 10.9 | " | 15.1 | S-3 | 21.0 |
| 10 | " | 10.9 | " | 10.9 | " | 15.1 | F | 21.0 |
| 11 | " | 10.9 | " | 10.9 | " | 15.0 | J | 21.0 |

Materials other than those of the invention, which were used in the comparative dispersions or in the preparation of the photographic elements described in Tables 1 and 2 are shown below. Comparative coupler CC-1, which is outside the scope of the invention, would have provided a closer comparison with coupler IC-7. Unfortunately, comparative coupler CC-1, proved very difficult to dissolve and needed ethyl acetate to form a suitable coupler solution, but even so the coating had crystals. Contrast and light stability were very poor, as was dye hue which showed significant unwanted green absorption ($D_{530}$ greater than 0.3). Comparative coupler CC-3 was chosen instead because it showed significantly better solubility.

Coupler YC-1

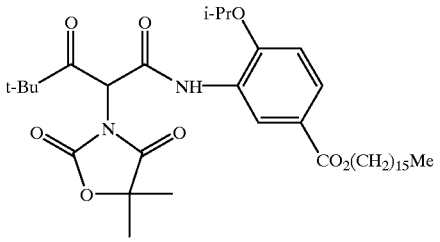

Coupler YC-2

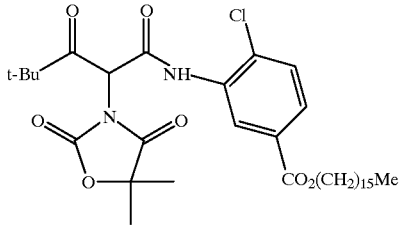

-continued
Coupler MC-1
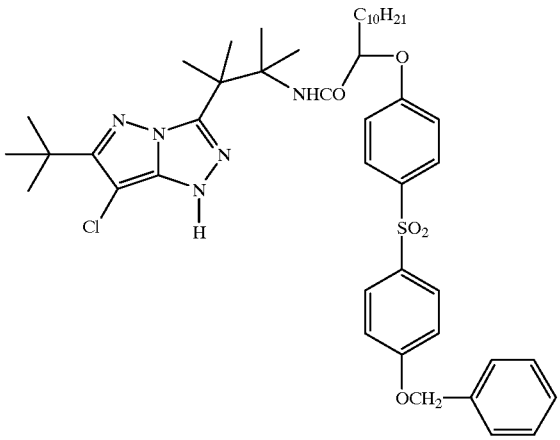
Coupler MC-2
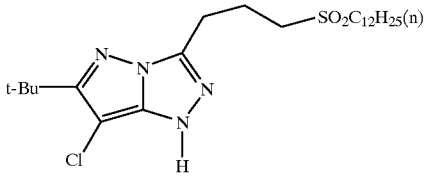
Coupler CC-3
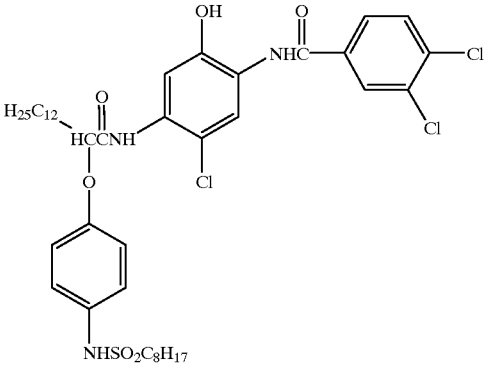
Solvent A
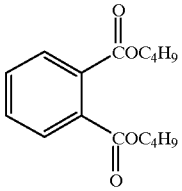
Solvent B
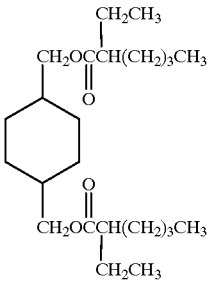
Solvent E
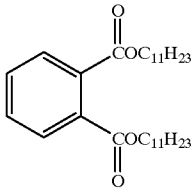
Solvent F
$CH_3(CH_2)_7CHCH(CH_2)_8OH$
Solvent J
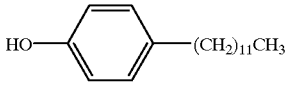

-continued

Solvent M

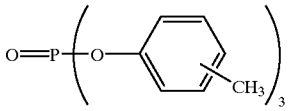

Layer 5
Comparative
stabilizer L

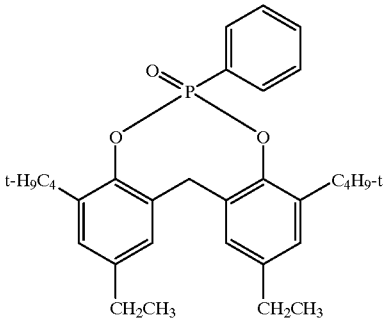

Layer 3
Fade prevention
agent C

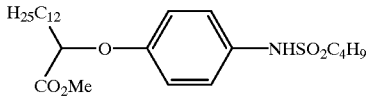

Layer 3
Fade prevention
agent D

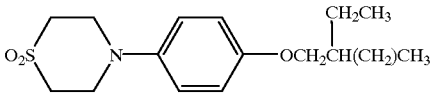

Layer 1
Fade prevention
agent H

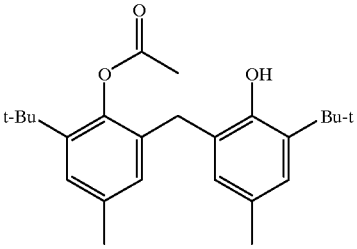

Layer 1
Fade prevention
agent J

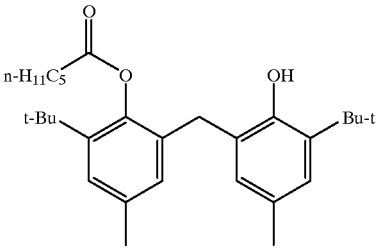

Layer 1
Fade prevention
agent N

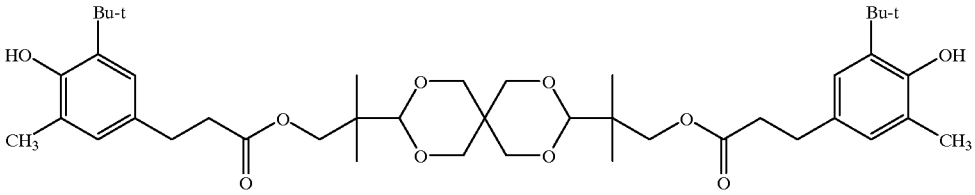

Stain prevention
agent G

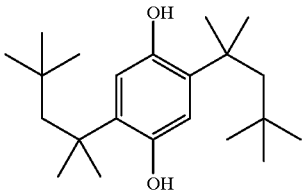

Hardener K

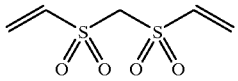

N-t-butylacrylamide/n-butylacrylate Copolymer (50:50)
Polymer O

Preparation of Photographic Elements

A light sensitive photographic multilayer coating was made to the following format shown in Table 3 below. The dispersions made to the formulations described in Table 2 above were incorporated in layer 5 at the laydowns shown hereinafter in Table 4.

TABLE 3

Structure of Photographic Element

| Layer | Component | Coverage |
|---|---|---|
| Layer 7 | Gelatin | 0.57 g/m$^2$ |
| Layer 6 | Gelatin | 0.62 g/m$^2$ |
| (UV light absorbing | UV light absorbing agents - (ST-1:ST-3 1:0.18) | 0.15 g/m$^2$ |

TABLE 3-continued

| Structure of Photographic Element | | |
|---|---|---|
| Layer | Component | Coverage |
| layer) | Stain prevention agent, G | 42.0 mg/m$^2$ |
| | Solvents for UV absorbing agents - (A:B, 1:1) | 0.06 g/m$^2$ |
| Layer 5 (Red-sensitive layer) | Gelatin | 1.36 g/m$^2$ |
| | Silver Chloride emulsion | 0.15 g Ag/m$^2$ |
| | Coupler(s) | See Tab. 4 |
| | Stabilizer for cyan coupler(s) | See Tab. 4 |
| | Solvent for cyan coupler(s) | See Tab. 4 |
| | Hardener, K | 0.18 g/m$^2$ |
| Layer 4 (UV light absorbing layer) | Gelatin | 0.74 g/m$^2$ |
| | UV light absorbing agents (ST-1:ST-3, 1:0.18) | 0.22 g/m$^2$ |
| | Stain prevention agent, G | 62.6 mg/m$^2$ |
| | Solvent for UV absorbing agents (A:B, 1:1) | 0.09 g/m$^2$ |
| Layer 3 (green sensitive layer) | Gelatin | 1.42 g/m$^2$ |
| | Silver chloride emulsion | 0.12 g/m$^2$ |
| | Magenta coupler, MC-1 | 0.31 g/m$^2$ |
| | Fade prevention agents: (C:D, 1.9:0.3) | 0.67 g/m$^2$ |
| | Solvents for magenta coupler (E:F, 0.35:0.67) | 0.32 g/m$^2$ |
| Layer 2 (color stain preventing layer) | Gelatin | 0.75 g/m$^2$ |
| | Stain prevention agent, G | 107.6 mg/m$^2$ |
| | Solvent for stain prevention agent; A | 0.19 g/m$^2$ |
| Layer 1 (blue-sensitive layer) | Gelatin | 1.31 g/m$^2$ |
| | Silver chloride emulsion | 0.27 g/m$^2$ |
| | Yellow coupler, YC-1 | 0.65 g/m$^2$ |
| | Fade prevention agents: (H:I, 0.17:0.06) | 0.22 g/m$^2$ |
| | Solvent for yellow coupler, F | 0.29 g/m$^2$ |
| Support | Gelatin over polyethylene laminated paper base | 0.30 g/m$^2$ |

Preparation of Processed Photographic Examples

Processed samples were prepared by exposing the coatings through a step tablet (density range 0–3, 0.15 inc.) and developed for 0.1 s and processed through a Kodak Process RA-4 as follows.

| Process Step | Time (min.) | Temp. (° C.) |
|---|---|---|
| Developer | 0.75 | 35.0 |
| Bleach-Fix | 0.75 | 35.0 |
| Water wash | 1.50 | 35.0 |

The processing solutions used in the above process had the following compositions (amounts/litre solution):

Developer

| | |
|---|---|
| Triethanolamine | 12.41 g |
| Blankophor REU (trademark of Mobay Corp.) | 2.30 g |
| Lithium polystyrene sulfonate | 0.09 g |
| N,N-Diethylhydroxylamine | 4.59 g |
| Lithium sulfate | 2.70 g |
| Developing agent, Dev-1 | 5.00 g |
| 1-Hydroxyethyl-1,1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7° C. | |

Bleach-Fix

| | |
|---|---|
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenedlaminetetraacetate | 48.58 g |

-continued

| | |
|---|---|
| Ethylenedlaminetetraacetic acid | 3.86 g |
| pH adjusted to 6.7 at 26.7° C. | |

Dev-1

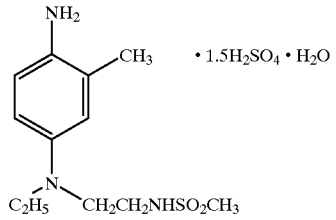

The Status A red densities of the processed strips were read and sensitometric curves (density vs. log exposure (D logE)) were generated. The contrast (γ) was measured by calculating the slope of the D logE plot over the range of 0.6 logE centred on the exposure yielding 1.0 density. This value is reported in Table 4.

The reflectance spectra of the image dyes were also measured and normalised to a maximum absorption of 1.00. From these spectra the wavelength of maximum absorption was recorded as $\lambda_{max}$. As a measure of the sharpness of the curve on the left hand side (i.e. the short wavelength side) of the absorption band the LBW was obtained by subtracting from $\lambda_{max}$ the wavelength at the point on the left-hand side of the absorption band where the normalised density was 0.5. A lower value of LBW indicated a reduction in the unwanted green absorption and was thus desirable. An additional measure of unwanted green absorption from the cyan dye is the density at 530 nm ($D_{530}$) in the normalised spectra. Again a lower value indicated less unwanted green absorption, which was desirable. The values for $\lambda_{max}$, LBW and density at 530 nm are shown in Table 4.

The light stability of the image dyes was tested by exposing the processed strips to the light from a Xenon arc lamp at an intensity of 50 klux for four weeks. The fade from the initial density of 1.00 was reported as a percentage under the column heading "Light fade" in Table 4. Any values greater than that of the commercial example (represented by element 101) were undesirable.

The degree of smearing of the cyan dye was tested by incubating the exposed and processed strips at 38° C. and 80% relative humidity for 19 days. The change from the initial density of 1.00 was reported as a percentage under the column heading "Smear" in Table 4. Any values greater than that of Element 101 were undesirable.

Results from Example 4

The results show that although Elements 101 and 102 have the most bathochromic $\lambda_{max}$, these elements also show the most unwanted green absorption by virtue of the higher LBW values and $D_{530}$ values.

The results also show that while elements 103 and 104 have very desirable dye hues, their light stability is worse than that of Element 101. However, the combination of the two types of couplers of formulae (I) and (II) in Elements 105 to 110 provided better light stability than that of a coupler of formula (I) alone as employed in Elements 103 and 104.

The differences in the results reported for Elements 102 and 108 show why the structure of the ballast of the IC couplers is important. These two elements are direct comparisons in terms of their laydowns and combinations of solvent, stabilizer and coupler IIC-3. However, replacing the comparative coupler CC-3 (which is in Element 102) with IC-7 (which is in Element 108) results in a desirable decrease in unwanted green absorption and also improves light stability.

TABLE 4

Photographic results for Example 4

| Element | Dispn. No. | Coupler I & laydown ($g/m^2$) | Coupler II & laydown ($g/m^2$) | Solvent & laydown ($g/m^2$) | Stabilizer & laydown ($g/m^2$) | $\lambda_{max}$ (nm) | LBW (nm) | $D_{530}$ | g | Light fade | Smear | Comment |
|---|---|---|---|---|---|---|---|---|---|---|---|---|
| 101 | 1 | — | IIC-3 | A | ST-1 | 659.8 | 80.5 | 0.250 | 2.67 | 24 | 2 | Comp. |
| | | — | 0.423 | 0.415 | 0.272 | | | | | | | |
| 102 | 2 | CC-3 | IIC-3 | S-1 | ST-1 | 649.3 | 80.5 | 0.263 | 2.81 | 27 | 4 | Comp. |
| | | 0.175 | 0.175 | 0.337 | 0.242 | | | | | | | |
| 103 | 3 | IC-7 | — | S-1 | ST-1 | 624.2 | 45.8 | 0.179 | 2.86 | 31 | −1 | Comp. |
| | | 0.350 | — | 0.200 | 0.210 | | | | | | | |
| 104 | 4 | IC-7 | — | F + J | L | 624.2 | 45.3 | 0.174 | 2.97 | 28 | −1 | Comp. |
| | | 0.350 | — | 0.315 | 0.210 | | | | | | | |
| 105 | 5 | IC-7 | IIC-3 | S-1 | ST-1 | 647.7 | 72.9 | 0.216 | 2.67 | 22 | 2 | Inv. |
| | | 0.070 | 0.280 | 0.210 | 0.350 | | | | | | | |
| 106 | 6 | IC-7 | IIC-3 | S-1 | ST-1 | 627.1 | 50.2 | 0.185 | 3.19 | 22 | 2 | Inv. |
| | | 0.280 | 0.070 | 0.210 | 0.350 | | | | | | | |
| 107 | 7 | IC-7 | IIC-3 | S-1 | ST-1 | 627.0 | 52.4 | 0.201 | 3.71 | 23 | 0 | Inv. |
| | | 0.280 | 0.070 | 0.490 | 0.350 | | | | | | | |
| 108 | 8 | IC-7 | IIC-3 | S-1 | ST-1 | 636.4 | 63.2 | 0.212 | 3.19 | 22 | 2 | Inv. |
| | | 0.175 | 0.175 | 0.337 | 0.242 | | | | | | | |
| 109 | 9 | IC-7 | IIC-3 | S-3 | ST-1 | 644.5 | 62.3 | 0.205 | 2.85 | 21 | 2 | Inv. |
| | | 0.175 | 0.175 | 0.337 | 0.242 | | | | | | | |
| 110 | 10 | IC-7 | IIC-3 | J | ST-1 | 644.5 | 65.7 | 0.181 | 3.11 | 20 | 5 | Inv. |
| | | 0.175 | 0.175 | 0.337 | 0.242 | | | | | | | |

Example 5

It could be construed from Example 4 that the laydown of stabilizer ST-1 has a significant effect on the light stability of IC-7. Thus the differences between the comparative Element 103 and the Inventive Elements 105 to 110 could be interpreted as being due to the increased levels of ST-1 in the elements of the invention. To test this, two dispersions were made for this Example using the same homogenisation method as described in Example 4. One of the dispersions was made to the same components and ratios as Sample No. 1 and the other had the same components and ratios as Sample No.7 as in Table 2.

The dispersions were coated in the same multilayer format as described in Example 4 but the layer 5 laydowns used were those described in Table 5 below. The coatings were exposed and processed as described for Example 4. The Status A red densities of the processed strips were read and sensitometric curves (D logE) were generated as before. The contrast (γ) was measured as before and reported in Table 5 below. Any values below that of the comparison example (element 111) were undesirable.

As before, the light stability of the image dyes was tested by exposing the processed strips to the light from a Xenon arc lamp at an intensity of 50 klux for four weeks. The fade from the initial density of 1.00 was reported as a percentage under the column heading "Light fade" in Table 5. Any values greater than that of comparison example (represented by element 111) were undesirable.

Also tested was the dark stability of the photographic elements. This was done by incubating the exposed and processed coatings for 12 weeks at 75° C. and 50% relative humidity. The decrease from the fresh density of 1.00 was measured. This was reported as a percentage fade under the column heading "Dark Fade". A low percentage of fade was desirable.

TABLE 5

Photographic Results for Example 5

| Element | Coupler I & laydown ($g/m^2$) | Coupler II & laydown ($g/m^2$) | Solvent & laydown ($g/m^2$) | Stabilizer & laydown ($g/m^2$) | γ | Light Fade | Dark Fade | Comment |
|---|---|---|---|---|---|---|---|---|
| 111 | — | IIC-3 | A | ST-1 | 2.71 | 25 | 30 | Comp. |
| | | 0.423 | 0.415 | 0.272 | | | | |
| 112 | IC-7 | IIC-3 | S-1 | ST-1 | 3.27 | 23 | 16 | Inv. |
| | 0.175 | 0.175 | 0.337 | 0.242 | | | | |
| 113 | IC-7 | IIC-3 | S-1 | ST-1 | 3.21 | 23 | 17 | Inv. |
| | 0.150 | 0.150 | 0.288 | 0.208 | | | | |
| 114 | IC-7 | IIC-3 | S-1 | ST-1 | 3.05 | 24 | 15 | Inv. |
| | 0.125 | 0.125 | 0.240 | 0.173 | | | | |

The results in Table 5 show that even if the overall coupler, solvent and stabilizer laydown is reduced, the invention still shows superior contrast, light stability and dark stability when compared with the comparative example in Table 5. Note that the laydown of Stabilizer ST-1 is at its lowest in Element 114, but contrast, light stability and dark stability are still acceptable.

Example 6

A further illustration of the invention can be seen in this example. Dispersions were made using the same method as described in Example 4, but with the ratios of oil phase materials in the dispersions adjusted to achieve the laydowns shown below in Table 6. The photographic elements were prepared in the same way as those described in Example 4, using the format described in Table 3. The photographic coatings were exposed and processed using the same method as described in Example 3. Contrast, (γ), and light fade were also measured in the same way as described in Example 4 and are reported in Table 6.

TABLE 6

Photographic results for Example 6

| Element | Coupler I & laydown (mmol/m$^2$) | Coupler II & laydown (mmol/m$^2$) | Solvent & laydown (g/m$^2$) | Stabilizer & laydown (g/m$^2$) | γ | Light fade | Comment |
|---|---|---|---|---|---|---|---|
| 115 | — | IIC-3 0.831 | A 0.415 | ST-1 0.272 | 2.77 | 25 | Comp. |
| 116 | CC-3 0.200 | IIC-3 0.216 | S-3 0.350 | ST-1 0.252 | 2.40 | 31 | Comp. |
| 117 | IC-7 0.219 | IIC-3 0.216 | S-1 0.350 | ST-1 0.252 | 3.12 | 21 | Inv. |
| 118 | IC-7 0.179 | IIC-3 0.177 | S-1 0.286 | ST-1 0.206 | 2.83 | 22 | Inv. |

It has already been seen in Example 4 that the dye hue generated by a combination of the two coupler classes of the invention is superior to that of the combination of the comparative coupler CC-3 with coupler IIC-3. It is shown in Table 6 above that the invention illustrated by Elements 117 and 118 provides better contrast and light stability than the comparative examples, even if coated at lower laydowns. This has benefits for rapid processing because lower laydowns generally lead to shorter processing times for development.

Example 7

A light sensitive photographic multilayer coating was made to the following format shown in Table 7 below. The dispersions for layer 5 were made to the same method as described in Example 4, but the components in the oil phase were adjusted to achieve the laydowns reported in Table 8.

TABLE 7

Coating format used in Example 7

| Layer | Component | Coverage |
|---|---|---|
| Layer 7 | Gelatin | 0.65 g/m$^2$ |
| Layer 6 (UV light absorbing layer) | Gelatin | 0.54 g/m$^2$ |
| | UV light absorbing agents - (ST-1:ST-3 1:0.18) | 0.15 g/m$^2$ |
| | Stain prevention agent, G | 42.0 mg/m$^2$ |
| | Solvents for UV absorbing agents - (A:B, 1:1) | 0.05 g/m$^2$ |
| Layer 5 (Red- | Gelatin | 1.36 g/m$^2$ |
| | Silver chloride emulsion | See Tab. 8 |

TABLE 7-continued

Coating format used in Example 7

| Layer | Component | Coverage |
|---|---|---|
| sensitive layer) | Coupler(s) | See Tab. 8 |
| | Stabilizer for cyan coupler(s) | See Tab. 8 |
| | Solvent for cyan coupler(s) | See Tab. 8 |
| Layer 4 (UV light | Gelatin | 0.71 g/m$^2$ |
| | For Element 119: | |
| absorbing layer) | UV light absorbing agents (ST-1:ST-3, 1:0.18) | 0.20 g/m$^2$ |
| | Stain prevention agent, G | 55.4 mg/m$^2$ |
| | Solvent for UV absorbing agents (A:B, 1:1) | 0.07 g/m$^2$ |

TABLE 7-continued

Coating format used in Example 7

| Layer | Component | Coverage |
|---|---|---|
| | For Elements 120 & 121: | |
| | Stain prevention agent, G | 64.6 mg/m$^2$ |
| | Solvent for stain prevention agent, A | 0.184 g/m$^2$ |
| Layer 3 (green- | Gelatin | 1.42 g/m$^2$ |
| | Silver chloride emulsion | 0.08 g/m$^2$ |
| sensitive | Magenta coupler, MC-2 | 0.24 g/m$^2$ |
| layer) | Fade prevention agents: (C:D, 1.9:0.3) | 0.24 g/m$^2$ |
| | Solvents for magenta coupler (E:F, 0.35:0.67) | 0.52 g/m$^2$ |
| Layer 2 (color | Gelatin | 0.75 g/m$^2$ |
| | For Element 119: | |
| stain- | Stain prevention agent, G | 0.07 g/m$^2$ |
| preventing | Solvent for stain prevention agent, A | 0.20 g/m$^2$ |
| layer) | For Elements 120 and 121: | |
| | Stain prevention agent, G | 0.11 g/m$^2$ |
| | Solvent for stain prevention agent, A | 0.31 g/m$^2$ |
| Layer 1 | Gelatin | 1.31 g/m$^2$ |
| (blue- | Hardener, K | 0.15 g/m$^2$ |
| sensitive | For Element 119: | |
| layer) | Silver chloride emulsion | 0.24 g/m$^2$ |
| | Yellow coupler, YC-2 | 0.41 g/m$^2$ |
| | Fade prevention agents (H:I:N, 0.22:0.07:0.29) | 0.24 g/m$^2$ |
| | Solvent for yellow coupler, S-4 | 0.22 g/m$^2$ |
| | Polymer, O | 0.48 g/m$^2$ |
| | For Elements 120 & 121: | |
| | Silver chloride emulsion | 0.29 g/m$^2$ |

TABLE 7-continued

Coating format used in Example 7

| Layer | Component | Coverage |
|---|---|---|
| | Yellow coupler, YC-1 | 0.48 g/m$^2$ |
| | Fade prevention agents-(H:I, 0.26:0.09) | 0.17 g/m$^2$ |
| | Solvent for yellow coupler, S-6 | 0.32 g/m$^2$ |
| Support | Polyethylene laminated paper base | |

The photographic coatings were exposed and processed using the same method as described in Example 4. Dye hue and light fade were also measured in the same way as described in Example 4 and are reported in Table 8.

TABLE 8

Photographic results for Example 6

| Element | Coupler I & laydown (g/m$^2$) | Coupler II & laydown (g/m$^2$) | Solvent & laydown (g/m$^2$) | Stabilizer & laydown (g/m$^2$) | Silver laydown (g/m$^2$) | $\lambda_{max}$ (nm) | LBW (nm) | $D_{530}$ | Light fade | Comment |
|---|---|---|---|---|---|---|---|---|---|---|
| 119 | — | IIC-3 | M | ST-1 | 0.194 | 657.4 | 85.4 | 0.270 | 24 | Comp. |
| | — | 0.35 | 0.595 | 0.361 | | | | | | |
| 120 | IC-35:IC-36 | — | S-1 | ST-1 | 0.150 | 631.9 | 53.9 | 0.225 | 16 | Comp. |
| | 0.287* | — | 0.580 | 0.580 | | | | | | |
| 121 | IC-35 | IIC-3 | S-1 | ST-1 | 0.150 | 633.3 | 59.3 | 0.249 | 12 | Inv. |
| | 0.201 | 0.086 | 0.580 | 0.580 | | | | | | |

*Ratio of IC-35 to IC-36 was 9:1

The data from Table 8 shows the effect of combining a different aggregating coupler, IC-35, with IIC-3 in Element 121. The dye hue data shows that with this combination the level of unwanted green absorption is less than that of Element 119. The light stability of the combination of the two classes of coupler is superior to either of the elements where the two classes of coupler are coated alone. A combination of two IC couplers (IC-35 and IC-36) in Element 120 showed improved light stability to that of IIC-3 alone (in Element 119), but was not as good as that derived from the combination of IC-35 and IIC-3 in Element 121. It would have been expected that the light stability of the combination in Element 121 would have been somewhere between the results derived from the other two elements, but the combination has shown an unexpected advantage.

The entire contents of the various patent applications, patents and other publications referred to in this specification are incorporated herein by reference.

The invention has been described in detail with particular reference to certain preferred embodiments thereof, but it will be understood that variations and modifications can be effected within the spirit and scope of the invention.

What is claimed is:

1. A photographic element comprising at least one light-sensitive silver halide emulsion layer having associated therewith:

(A) a phenolic cyan dye-forming "NB coupler" having the formula (IA):

(IA)

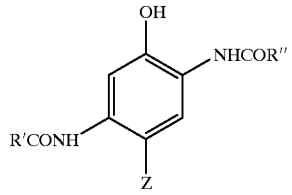

wherein:

R' and R" are independently selected substituents such that the coupler is a "NB coupler" and Z is a hydrogen atom or a group which can be split off by the reaction of the coupler with an oxidized color developing agent;

(B) a phenolic cyan dye-forming coupler of formula (II):

(II)

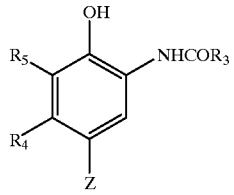

wherein:

$R_3$ is an unsubstituted or substituted alkyl or aryl group or a 5–10 membered heterocyclic ring which contains one or more heteroatoms selected from nitrogen, oxygen and sulfur, which ring is unsubstituted or substituted;

$R_4$ is an unsubstituted or substituted alkyl group;

$R_5$ is hydrogen, halogen or an unsubstituted or substituted alkyl or aryl group or a 5–10 membered heterocyclic ring which contains one or more heteroatoms selected from nitrogen, oxygen and sulfur, which ring is unsubstituted or substituted; and Z is a hydrogen atom or a group which can be split off by the reaction of the coupler with an oxidized color-developing agent; and (C) a stabilizer of formula (III)

(III)

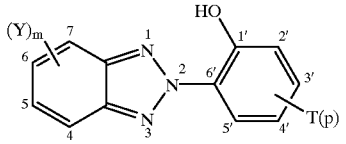

wherein:

each Y is an independently selected substituent and m is 0 to 4; and each T is an independently selected substituent and p is 0 to 4.

2. An element according to claim 1 wherein the absorption spectrum of the dye, formed from coupling the "NB coupler" with the developer 4-amino-3-methyl-N-ethyl-N-(2-methanesulfonamidoethyl)aniline sesquisulfate hydrate, in di-n-butyl sebacate upon "spin coating" is at least 15 nm less than the LBW for a 3% w/v solution of the same dye in acetonitrile.

3. An element according to claim 2 wherein the LBW of the absorption spectrum of the dye in di-n-butyl sebacate upon "spin coating" is at least 25 nm less than the LBW for a 3% w/v solution of the same dye in acetonitrile.

4. An element according to claim 1 wherein R' and R" are independently selected from an unsubstituted or substituted alkyl, amino, alkoxy or aryl group or a 5–10 membered heterocyclic ring which contains one or more heteroatoms selected from nitrogen, oxygen and sulfur, which ring is unsubstituted or substituted.

5. An element according to claim 4 wherein R" is an unsubstituted or substituted aryl group.

6. An element according to claim 4 wherein R' is a substituted alkyl group.

7. An element according to claim 1 wherein the "NB coupler" has the formula (I)

(I)

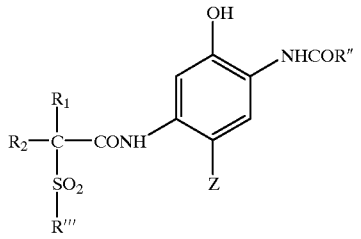

wherein:

R" is a substituent;

Z is a hydrogen atom or a group which can be split off by the reaction of the coupler with an oxidized color-developing agent;

$R_1$ and $R_2$ are independently hydrogen or an unsubstituted or substituted alkyl group; and R"' is an unsubstituted or substituted alkyl, amino, alkoxy or aryl group or a 5–10 membered heterocyclic ring which contains one or more heteroatoms selected from nitrogen, oxygen and sulfur, which ring is unsubstituted or substituted.

8. An element according to claim 7 wherein R" is an unsubstituted or substituted phenyl group.

9. An element according to claim 7 wherein R"' is an unsubstituted or substituted phenyl group.

10. An element according to claim 7 wherein at least one of $R_1$ and $R_2$ is a hydrogen atom.

11. An element according to claim 1 wherein in formula (II) $R_3$ is an unsubstituted or substituted alkyl group.

12. An element according to claim 1 wherein in formula (II) $R_4$ is an unsubstituted alkyl group.

13. An element according to claim 1 wherein in formula (II) $R_5$ is halogen or an unsubstituted or substituted alkyl group.

14. An element according to claim 1 wherein in formula (III) the 5-position and/or 6-position is unsubstituted or independently substituted with chlorine, a nitro group, an unsubstituted alkyl or an alkoxycarbonyl group.

15. An element according to claim 1 wherein in formula (III) the 3' and 5'-positions of the phenyl ring are unsubstituted and the 2'- and/or 4'-positions are independently substituted with an unsubstituted or substituted alkyl, alkoxy or aryloxy group.

16. An element according to claim 15 wherein the ring is di-substituted at the 2'and 4'-positions.

17. An element according to claim 1 wherein there is associated therewith one or more high-boiling solvents of formula (IV)

(IV)

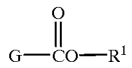

wherein:

$R^1$ is an unsubstituted or substituted alkyl or aryl group; and

G is an unsubstituted or substituted alkyl group.

18. An element according to claim 17 wherein $R^1$ is an unsubstituted alkyl group.

19. An element according to claim 17 wherein $R^1$ is an alkyl group substituted with one or more hydroxy, alkoxy, alkoxycarbonyl or carboxylic ester groups.

20. An element according to claim 17 wherein G is an alkyl group substituted with one or more hydroxy or carboxylic ester groups.

21. A photographic element comprising at least one light-sensitive silver halide emulsion layer having associated therewith:

(A) a cyan dye-forming coupler of formula (I)

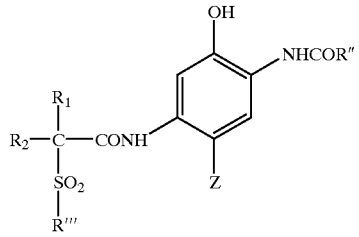

wherein:

$R_1$ and $R_2$ are independently hydrogen or an unsubstituted or substituted alkyl group;

R" and R"' are independently selected from an unsubstituted or substituted alkyl, amino, alkoxy or aryl group or a 5–10 membered heterocyclic ring which contains one or more heteroatoms selected from nitrogen, oxygen and sulfur, which ring is unsubstituted or substituted; and Z is a hydrogen atom or a group which can be split off by the reaction of the coupler with an oxidized color-developing agent;

(B) a phenolic cyan dye-forming coupler of formula (II):

(II)

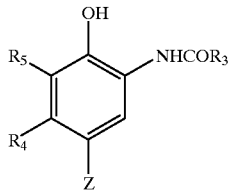

wherein:

$R_3$ is an unsubstituted or substituted alkyl or aryl group or a 5–10 membered heterocyclic ring which contains one or more heteroatoms selected from nitrogen, oxygen and sulfur, which ring is unsubstituted or substituted;

$R_4$ is an unsubstituted or substituted alkyl group;

$R_5$ is hydrogen, halogen or an unsubstituted or substituted alkyl or aryl group or a 5–10 membered heterocyclic ring which contains one or more heteroatoms selected from nitrogen, oxygen and sulfur, which ring is unsubstituted or substituted; and Z is a hydrogen atom or a group which can be split off by the reaction of the coupler with an oxidized color-developing agent; and (C) a stabilizer of formula (III)

(III)

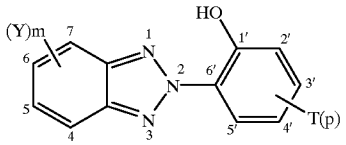

wherein:

each Y is an independently selected substituent and m is 0 to 4; and each T is an independently selected substituent and p is 0 to 4.

22. An element according to claim 21 wherein there is associated therewith one or more high-boiling solvents of formula (IV)

(IV)

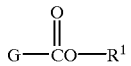

wherein:

$R^1$ is an unsubstituted or substituted alkyl or aryl group; and

G is an unsubstituted or substituted alkyl group.

23. An element according to claim 1 wherein the laydown of total coupler is from about 0.10 mmol/$m^2$ to about 1.5 mmol/$m^2$.

24. An element according to claim 23 wherein the laydown of total coupler is from about 0.19 mmol/$m^2$ to about 0.55 mmol/$m^2$.

25. An element according to claim 1 wherein the ratio of "NB coupler" to coupler of formula (II) is from about 25:75 to about 90:10.

26. An element according to claim 25 wherein the "NB coupler" and coupler of formula (II) are in equimolar proportions.

27. An element according to claim 1 wherein the ratio of stabilizer to total coupler is from about 0.01:1 to about 4:1.

28. An element according to claim 27 wherein the ratio of stabilizer to total coupler is from about 0.5:1 to about 2:1.

29. An element according to claim 1 wherein the ratio of solvent to total coupler is from about 0.2:1 to about 4:1.

30. An element according to claim 29 wherein the ratio of solvent to total coupler is from about 0.5:1 to about 2:1.

31. A multi-color photographic element comprising a support bearing yellow, magenta and cyan image-dye-forming units comprising at least one blue-, green- or red-sensitive silver halide emulsion layer having associated therewith at least one yellow, magenta or cyan dye-forming coupler respectively, wherein the element comprises at least one light-sensitive silver halide emulsion layer having associated therewith:

(A) a phenolic cyan dye-forming "NB coupler" having the formula (IA):

(IA)

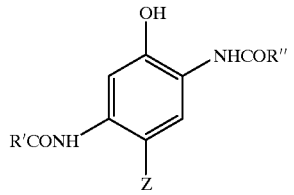

wherein:

R' and R" are independently selected substituents such that the coupler is a "NB coupler" and Z is a hydrogen atom or a group which can be split off by the reaction of the coupler with an oxidized color developing agent;

(B) a phenolic cyan dye-forming coupler of formula (II):

(II)

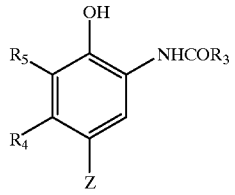

wherein:

$R_3$ is an unsubstituted or substituted alkyl or aryl group or a 5–10 membered heterocyclic ring which contains one or more heteroatoms selected from nitrogen, oxygen and sulfur, which ring is unsubstituted or substituted;

$R_4$ is an unsubstituted or substituted alkyl group;

$R_5$ is hydrogen, halogen or an unsubstituted or substituted alkyl or aryl group or a 5–10 membered heterocyclic ring which contains one or more heteroatoms selected from nitrogen, oxygen and sulfur, which ring is unsubstituted or substituted; and Z is a hydrogen atom or a group which can be split off by the reaction of the coupler with an oxidized color-developing agent; and (C) a stabilizer of formula (III)

(III)

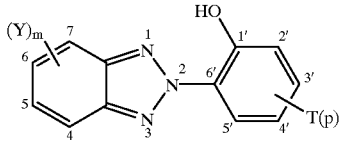

wherein:

each Y is an independently selected substituent and m is 0 to 4; and each T is an independently selected substituent and p is 0 to 4.

32. A process of forming an image in a photographic element as hereinbefore defined after the element has been imagewise exposed to light, comprising contacting an element with a color-developing agent, the element comprising at least one light-sensitive silver halide emulsion layer having associated therewith:

(A) a phenolic cyan dye-forming "NB coupler" having the formula (IA):

(IA)

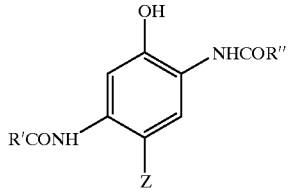

wherein:

R' and R" are independently selected substituents such that the coupler is a "NB coupler" and Z is a hydrogen atom or a group which can be split off by the reaction of the coupler with an oxidized color developing agent;

(B) a phenolic cyan dye-forming coupler of formula (II):

(II)

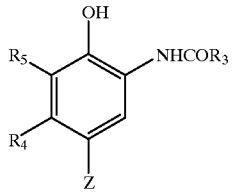

wherein:

$R_3$ is an unsubstituted or substituted alkyl or aryl group or a 5–10 membered heterocyclic ring which contains one or more heteroatoms selected from nitrogen, oxygen and sulfur, which ring is unsubstituted or substituted;

$R_4$ is an unsubstituted or substituted alkyl group;

$R_5$ is hydrogen, halogen or an unsubstituted or substituted alkyl or aryl group or a 5–10 membered heterocyclic ring which contains one or more heteroatoms selected from nitrogen, oxygen and sulfur, which ring is unsubstituted or substituted; and Z is a hydrogen atom or a group which can be split off by the reaction of the coupler with an oxidized color-developing agent; and (C) a stabilizer of formula (III)

(III)

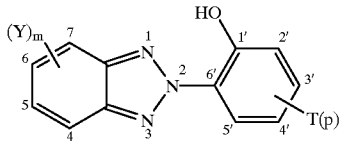

wherein:

each Y is an independently selected substituent and m is 0 to 4; and each T is an independently selected substituent and p is 0 to 4.

* * * * *